US006340157B1

(12) United States Patent
Watanabe et al.

(10) Patent No.: US 6,340,157 B1
(45) Date of Patent: Jan. 22, 2002

(54) RECORDING APPARATUS CAPABLE OF RECORDING IMAGES ON BOTH SIDES OF RECORDING PAPER

(75) Inventors: Kazuo Watanabe; Toshihiko Okamuro, both of Utsunomiya; Toshiyasu Inoue; Hiroshi Yoshida, both of Takanezawa-machi, all of (JP)

(73) Assignee: Matsushita Graphic Communication Systems, Inc., Tokyo (JP)

( * ) Notice: Subject to any disclaimer, the term of this patent is extended or adjusted under 35 U.S.C. 154(b) by 0 days.

(21) Appl. No.: 09/613,629

(22) Filed: Jul. 11, 2000

(30) Foreign Application Priority Data

Jul. 16, 1999 (JP) ..... 11-202966

(51) Int. Cl.[7] ..... B65H 39/10
(52) U.S. Cl. ..... 271/301; 271/186; 271/65
(58) Field of Search ..... 271/301, 186, 271/65; 399/364, 401

(56) References Cited

U.S. PATENT DOCUMENTS 5,196,897 A * 3/1993 Trask ..... 271/186 X
5,905,934 A * 5/1999 Koshimizu ..... 399/396

FOREIGN PATENT DOCUMENTS

JP 3-13463 1/1991

OTHER PUBLICATIONS

English Language abstract of JP–3–13463.

* cited by examiner

*Primary Examiner*—David H. Bollinger
(74) *Attorney, Agent, or Firm*—Greenblum & Bernstein, P.L.C.

(57) ABSTRACT

In a recording apparatus of the present invention, a both-side path is formed not to overlap with an area of a one-side path. Recording paper is inverted at a location of the both-side path, and then is returned to the one-side path. The both-side path is provided with paper removing mechanisms in respective areas corresponding to a bottom, top and rear of an housing. Thereby the removing mechanism of the both-side path does not superimpose with the one-side path.

23 Claims, 28 Drawing Sheets

RECORDING APPARATUS CAPABLE OF RECORDING IMAGES ON BOTH SIDES OF RECORDING PAPER

BACKGROUND OF THE INVENTION

1. Field of the Invention

The present invention relates to a recording apparatus with a feeding mechanism that inverts a sheet of recording paper with an image formed on one side thereof to form an image on the reverse side thereof (hereinafter referred to as both-side feeding path).

2. Description of the Related Art

Recently there is a recording apparatus capable of recording images on both sides of recording paper. The recording apparatus is provided with a both-side feeding path that inverts recording paper with an image recorded on one side thereof to return to a recording unit.

For example, a recording apparatus described in Japanese Unexamined Patent Publication HEI3-13463 is provided with a both-side feeding path branched from a one-side path in the periphery of the one-side feeding path. Thus providing the both-side path in the vicinity of the one-side path makes the total path length relatively short.

However the structure of the conventional recording apparatus as described above causes a problem that operability performed when paper jam occurs is poor.

That is, to provide for the case where the paper jam occurs, the feeding paths are provided with paper jam removing mechanisms. When the both-side path is arranged in the periphery of the one-side path, in the case where the jam occurs on the one-side path, an outer cover that is the jam removing mechanism of the both-side path is first opened to expose the both-side path, an inner cover that is the jam removing mechanism of the one-side path is next opened to expose the one-side path, and then the jammed paper is removed. In this case, when the one-side path is only provided, it is enough to open only the jam removing mechanism of the one-side path. However when the both-side path is provided in addition to the one-side path, it is necessary to open also the removing mechanism of the both-side path to remove the jam of the one-side path, and therefore the paper jam removing operation has been exceedingly complicated.

Further in the paper jam removing operation, the cover should be opened again to check when it is found out that the jam is not removed completely after removing the jammed paper once, shutting the cover, and watching for a while. Thus the opening and shutting of the removing mechanism is usually repeated frequently, accordingly resulting in the problem that the paper jam removing operation is seriously complicated.

SUMMARY OF THE INVENTION

The present invention is carried out in view of the foregoing. It is an object of the present invention to provide a recording apparatus enabling improved paper jam removing operability while being provided with a both-side path for both-side recording.

In the recording apparatus of the present invention, the both-side path is formed along an outer edge of an housing not to overlap with an area of a one-side path, and recording paper is inverted in the both-side path to be returned to the one-side path. The both-side path is provided with paper jam removing mechanisms in respective areas corresponding to a bottom, top and rear of the housing. It is thereby possible to construct the removing mechanisms of the both-side path which is not superposed by the one-side path, and consequently improve the paper jam removing operability.

A recording apparatus of a first aspect of the present invention has an housing composing an appearance of a main body of the apparatus, a recording section provided inside the housing, a one-side path, formed inside the housing, which feeds recording paper to the recording section, while discharging the recording paper with an image recorded thereon outside the housing, and a both-side path that circulates the recording paper along an outer edge of the housing where the one-side path is not present, and inverts the recording paper at a location on the both-side path to return to the one-side path.

According to this constitution, the both-side path is not provided peripherally adjacent the one-side path, but can be formed in an area without the one-side path, whereby it is possible to construct a removing mechanism of the both-side path in an area that does not interfere with the one-side path, and consequently to improve the paper jam removing operability.

A second aspect of the present invention adopts, in the recording apparatus of the first aspect, a constitution where the both-side path inverts the recording paper in a bottom area of the housing to return to the one-side path inside the housing.

According to this constitution, since the recording paper is inverted at the final area of the both-side path that is the closest to the area where the recording paper is returned to the one-side path, it is possible to provide the inversion section, where the paper jam and position shift tend to occur, in the vicinity of the one-side path. Therefore even in the case where the removing mechanisms for the one-side path and the removing mechanisms for the both-side path are provided separately, it is possible to remove the paper jam in the section of the both-side path where the paper jam and position shift tend to occur, in an area which is not away from the removing mechanism of the one-side path, and thus to prevent the removing mechanisms from being present in different areas of the apparatus, as possible.

A third aspect of the present invention adopts, in the recording apparatus of any of the first and second aspects, the both-side path which is a path circulating along outer edges of a top, rear and bottom of the housing to return to the one-side path inside the housing.

According to this constitution, circulating the both-side path along the outer edge of the housing increases straight portions of the path, while reducing sharp angle bend areas of the path, and thereby it is possible to form a structure with a paper jam hardly occurring. In particular, it is possible to suppress the occurrence of the paper jam even if the paper has a paper curl after being passed through the fixing unit once. Further since it is possible to form the both-side path utilizing spaces available outside the apparatus effectively, it is possible to improve the installation characteristic of the both-side path when the path is an option.

A 4th aspect of the present invention adopts, in the recording apparatus of the third aspect, the both-side path that has removing mechanisms for paper jam, each of which is independent of the housing, and present in one of respective areas corresponding to the top, rear and bottom of the housing.

When the both-side path is formed by being circulated along the outer edge of the housing, the total length of the both-side path becomes long. However according to this constitution, in order not to expose at one time all the areas of the both-side path, the removing mechanisms are present separately corresponding to straight areas of the both-side path, whereby when the paper jam occurs on the both-side path, it is possible to expose only a required portion of the straight areas each with a relatively simplified structure comprised of only rollers and guides without complicated metal plates, facilitating the paper jam removing operation.

A 5th aspect of the present invention adopts, in the recording apparatus of the third aspect, a constitution where the both-side path is formed inside a plurality of units located on the top, on the rear and under the bottom of the housing while being connected, each unit has a removing mechanism for paper jam independent of the housing, and a top unit is attached to the housing circularly movably.

When the recording paper is not fed smoothly from a discharge section of the one-side path to a take-in section of the both-side path, and the paper jam occurs, opening a cover mechanism of the top path finds out no recording paper to be removed because the paper is not fed to the top unit yet. However according to this constitution, by attaching the top unit to the housing circularly movably, the portion between the discharge section of the one-side path and the take-in section of the both-side path can be exposed, and thereby the jammed recording paper can be removed easily.

A 6th aspect of the present invention adopts, in the recording apparatus of the 4th aspect, a constitution where the removing mechanisms of the top unit and rear unit each is comprised of a cover, and a removing mechanism of a bottom unit is comprised of a drawer.

According to this constitution, all the removing mechanisms are not covers, and the removing mechanism of the bottom unit for the both-side path is comprised of a drawer mechanism, whereby it is possible to further install a paper feeding unit under the both-side path. Thereby it is possible to prevent the installation of the both-side path from limiting the installation of the paper feeding unit, and to achieve the paper jam removal on the both-side path.

A 7th aspect of the present invention adopts, in the recording apparatus of the 4th aspect, a constitution where the removing mechanism of the bottom of the both-side path is comprised of a drawer, the drawer stores an inversion mechanism that inverts the recording paper, and the inversion mechanism is drawn outside along with the drawer.

According to this constitution, when the drawer is drawn out, the inversion mechanism is drawn out together. Therefore it is possible to remove the paper jam in the inversion mechanism, where the paper jam tends to occur the most frequently, easily with an easy operation.

An 8th aspect of the present invention adopts, in the recording apparatus of the 7th aspect, the inversion mechanism having a pair of rollers that feed the recording paper while putting the recording paper therebetween.

According to this constitution, by providing the inversion mechanism with a pair of rollers to put the recording paper therebetween to feed, drawing out the drawer mechanism results in that the recording paper put between the rollers is drawn out, whereby it is possible to remove the jammed paper assuredly in the inversion mechanism.

A 9th aspect of the present invention adopts, in the recoding apparatus of the 7th aspect, the inversion mechanism having a guide that guides one side of the recording paper and another guide that guides the other side of the recording paper in a predetermined area.

According to this constitution, by providing the inversion mechanism with guides for both sides of the recording paper, drawing out the drawer mechanism results in that the recording paper put between the guides is drawn out. Accordingly even in the case where it is not possible to provide the inversion mechanism with a pair of rollers, it is possible to remove the jammed paper assuredly in the inversion mechanism.

A 10th aspect of the present invention adopts, in the recording apparatus of the 7th aspect, the inversion mechanism having a guide that guides one side of the recording paper and a roller that feeds the other side of the recording paper in a predetermined area.

According to this constitution, by providing the inversion mechanism with the guide that guides one side of the recording paper and the roller that feeds the other side of the recording paper, drawing out the drawer mechanism results in that the recording paper held by the guide is drawn out along with the drawer mechanism. Therefore even in the case where one roller is arranged in the inversion mechanism, and another roller is arranged in an apparatus side, it is possible to remove the jammed paper in the inversion mechanism assuredly.

An 11th aspect of the present invention adopts, in the recording apparatus of the 7th aspect, a constitution where the inversion mechanism is arranged in an innermost side in the direction in which the drawer is drawn out.

According to this constitution, by pinching the recording paper with both sides thereof in an innermost portion in the drawer that an operation hardly touches, when the paper jam occurs in such a portion, it is possible to prevent the operator from performing the complicated operation to draw out the drawer and remove the jammed paper while stretching the operator's hand to the innermost portion in a storage section that stores the drawer.

A 12th aspect of the present invention adopts, in the recording apparatus of any of the first to 11th aspects, a switching mechanism, provided at a branch point between a second path and a third path, which switches a path to which the recording paper coming from a first path goes, where the first path is a path connecting a discharge outlet of the one-side path and an inlet of the both-side path, the second path is a path connecting the first path and the both-side path, and the third path is a path connecting the first path and a discharge outlet of the both-side path, and a control section that guides the recording paper to the discharge outlet of the both-side path through the third path when the switching mechanism selects the path to feed the recording paper to the third path at the time recording on a second side is started in the both-side recording.

In the case where the switching mechanism does not operate sufficiently due to, for example, the aging, when the control is performed to return the recording paper to the switching mechanism while setting the direction of the switching mechanism in the right direction to feed the recording paper again, the paper jam tends to occur in a switching area of the path. However according to this constitution, since the recording paper is discharged to an incorrect path without correcting the path even when the switching mechanism provides the incorrect path, it is possible to prevent the occurrence of paper jam, also to notify the user of the abnormality of the apparatus by discharging the recording paper without any correction, and consequently to urge the operator to perform an appropriate action.

A 13th aspect of the present invention adopts, in the recording apparatus of the 12th aspect, a constitution where a discharge sensor is provided to detect the presence or absence of the recording paper to be discharged to the third path, and when the discharge sensor detects the recording paper at the time the recording on the second side is performed, the control section judges that the switching mechanism incorrectly guides the recording paper to the third path at the time the recording on the second side is started in the both-side recording.

According to this constitution, the discharge sensor on the third path that monitors at the time the second sided recording is finished is set to monitor at the time the second sided recording is started, whereby it is possible to judge the presence or absence of the malfunction using the preexisting discharge sensor without increasing the number of components.

A 14th aspect of the present invention adopts, in the recording apparatus of any of the first to 11th aspects, a switching mechanism, provided at a branch point between a second path and a third path, which switches a path to which the recording paper coming from a first path goes, where the first path is a path connecting a discharge outlet of the one-side path and an inlet of the both-side path, the second path is a path connecting the first path and the both-side path, and the third path is a path connecting the first path and a discharge outlet of the both-side path, and a control section that stops the recording paper at a predetermined position corresponding to the removing mechanism for paper jam of the both-side path when the switching mechanism guides the recording paper to the second path at the time the recording on the second side is finished in the both-side recording.

In the case where the switching mechanism does not operate sufficiently due to, for example, the aging, when the control is performed to return the recording paper to the switching mechanism while setting the direction of the switching mechanism in the right direction to feed the recording paper again, the paper jam tends to occur in the switching area of the path. However according to this constitution, in the case where the recording paper to be discharged is not discharged, the recording paper is stopped at the predetermined position corresponding to the removing mechanism of the both-side path, therefore it is possible to prevent the occurrence of the paper jam, and also to make the situation where the recording paper is present at the corresponding position when the removing mechanism of the both-side path is opened, facilitating the operation for removing the recording paper present in the incorrect path.

A 15th aspect of the present invention adopts, in the recording apparatus of the 14 aspect, a constitution where a discharge sensor is provided to detect the presence or absence of the recording paper to be discharged to the third path, and when the discharge sensor does not detect the recording paper after the elapse of a predetermined time at the time the recording on the second side is finished, the control section judges that the switching mechanism incorrectly guides the recording paper to the second path.

According to this constitution, by limiting the time for the discharge sensor on the third path to monitor, it is judged that the recording paper is present on the second path when the recording paper is not detected after monitoring for the predetermined time, whereby it is possible to judge the malfunction without increasing the number of components.

A 16th aspect of the present invention adopts, in the recording apparatus of any of the first to 15th aspects, a holding mechanism that holds a pinch roller provided opposite a driving roller that first drives the recording paper in the both-side path, by pressing opposite ends of a shaft of the pinch roller separately against sides of the driving roller.

The recording paper tends to skew at the first stage of the both-side path where the paper passed through the one-side path is taken in the both-side path because a top edge of the paper tends to miss the position at such a stage. Once the skew occurs at the first stage, it is difficult to compensate the skew at a portion directly before the recording that is the final stage of the both-side path because the degree of skew becomes larger due to the fact the both-side path has the long total length. However according to this constitution, by pressing the opposite ends of the shaft of the pinch roller separately at the first stage of the both-side path, it is possible to prevent the pinch rollers from pressing the feed rollers ununiformly, also to prevent the skew of the recording paper at the first stage of the both-side path, and consequently to prevent an image from being recorded askew in the recording section.

The 17th aspect of the present invention adopts, in the recording apparatus of any of the first to 16th aspects, a constitution with an inclination mechanism that forcibly inclines at a final area of the both-side path a direction of the recording paper to a reference surface in the direction in which a top end corner of the recording paper is first in contact with the reference surface, while feeding the paper, and a skew correction mechanism that corrects the direction of the recording paper to be straight along the reference surface to return to the one-side path, where the recording paper skews in the direction in which the top end corner of the recording paper is first in contact with the reference surface.

Circulating the both-side path along the outer edge of the housing results in the long total length of the both-side path, and as the length becomes longer, the skew tends to occur. However according to this constitution, on the assumption that the skew is present, the direction of the recording paper is inclined forcibly in the direction that the skew correction mechanism expects, and then fed to the skew correction mechanism, whereby it is possible to correct the skew of the recording paper assuredly, and to feed the recording paper with the straight direction to a recording section.

Further as compared to a structure in which a skew correction mechanism is moved to the recording paper, the constitution does not require a process to stop the feed of recording paper once, or move the skew correction mechanism, and thereby it is possible to perform the skew correction in the process in which the recording paper is fed originally, and to prevent the occurrence of time loss.

An 18th aspect of the present invention adopts, in the recording apparatus of the 17th aspect, the inclination mechanism having a mechanism that forcibly makes the recording paper skew in the opposite direction to the reference surface at a last stage before the final stage of the both-side path, and an inversion mechanism that feeds the recording paper skewing again starting from the rear end of the recording paper to invert a side of the recording paper.

According to this constitution, since by the use of the preexisting inversion mechanism the recoding paper is forcibly inclined while being fed, it is possible to incline the recording paper with a simplified construction.

A 19th aspect of the present invention adopts, in the recording apparatus of any of the first to 18th aspects, a constitution where a feed speed in an interval when a top end of the recording paper is fed to a transfer section and then a rear end of the recording paper is fed out of a fixing section is set to be lower than another feed speed in areas other than the interval.

According to this constitution, although the both-side path formed by being circulated along the outer edge of the housing results in the longer total length of the both-side path, the feed speed is switched to be higher in areas other than the process interval in which the feed speed is specified by the applied process. Therefore it is possible to maintain the appropriate speed in the process interval, and also to speed up the entire paper feeding.

A 20th aspect of the present invention adopts, in the recording apparatus according to any of the first to 19th aspects, the both-side path formed inside a plurality of units located on the top, on the rear and under the bottom of the housing while being connected, where the units are constructed in a separable way for each unit.

According to this constitution, it is possible to provide the recording apparatus comprised of only the housing to a user who does not require the both-side path, while providing the recording apparatus enabling both-side recording to another user who requires the both-side path, by later attaching the both-side path along the outer edge of the housing. Further since the both-side path is separated into the plurality of units, it is possible to prepare each unit in the form enabling the easy transportation, and to reduce the weight of each unit. Furthermore since each unit is attached along the outer edge of the housing sequentially to assemble, it is possible to improve the assembling characteristic.

A 21st aspect of the present invention adopts, in the recording apparatus of the 20th aspect, the plurality of units each having positioning materials for each unit also working as fixing materials to connect each unit to fix.

According to this constitution, the operation to connect the units to each other to fix is completed by the operation to match positions of the units by the positioning materials, and thereby it is possible to simplify operation processes to fix units, and to improve the assembling characteristic.

A 22nd aspect of the present invention adopts, in the recording apparatus according to any of the first to 21st aspects, a plurality of sensors arranged at spaced intervals that are longer than a length of the recording paper on the both-side path, and a control section that judges whether or not any of the sensors detects the recording paper while driving rollers on the both-side path at the initial operation time.

Since the both-side path thus circulated along the outer edge of the housing increases the total length of the feeding path, the number of sensors to be arranged is increased, and consequently the number of components is increased. However according to this constitution, sensors are arranged at the spaced intervals longer than the recording paper length, and the rollers are driven to feed the recording paper at the initial operation time, whereby the recording paper moves to the sensor when remains on the both-side path. It is thereby possible to suppress an increase of the number of components, and to detect whether or not the recording paper is present on the both-side path assuredly at the initial operation time.

A recording apparatus of a 23rd aspect of the present invention has an housing composing an appearance of a main body of the apparatus, a recording section provided inside the housing, a one-side path, formed inside the housing, which feeds recording paper to the recording section, while discharging the recording paper with an image recorded thereon outside the housing, a both-side path that circulates the recording paper discharged from the one-side path along an outer edge of the housing, where the one-side path is not present, to return to the one-side path, a switching mechanism that switches a path to which the recording paper discharged from the one-side path goes to the both-side path or a discharge outlet of the both-side path, an inversion section, provided on a location of the both-side path, which draws in the recording paper starting from a top end thereof, while pushing out the recording paper starting from a rear end thereof, to invert the recording paper, a first forward-reverse motor that controls the switching mechanism, and a second forward-reverse motor that switches between draw-in and push-out in the inversion section.

According to this constitution, in the case where two sheets of recording paper are fed to the both-side path to perform successive recording, the forward-reverse motors perform the switching of the recording paper feeding path in the switching mechanism, and the switching between the draw-in and push-out in the inversion section, and thus it is possible to control positions of the sheets of recording paper circulating on the both-side path by the forward-reverse motors. Therefore it is possible to control the positions of the sheets of recording paper with the simplified control performed only by switching the forward-reverse motors.

A 24th aspect of the present invention adopts, in the recording apparatus of the 23rd aspect, a constitution where the first forward-reverse motor controls a driving system in which the recording paper is fed from the switching mechanism to a location before the inversion section, and the second forward-reverse motor controls another driving system in which the recording paper is fed from the location to the one-side path inside the housing again through the inversion section.

According to this constitution, in the case where two sheets of recording paper are fed to the both-side path to perform the successive recording, the two forward-reverse motors are switched so that each sheet waits before returning to the one-side path in the housing, whereby it is possible to properly control the recording timing while properly holding an interval between the sheets of recording paper.

A 25th aspect of the present invention adopts, in the recording apparatus of the 24th aspect, a constitution where a sheet of recording paper is drawn out of the inversion section by a reverse rotation of the second forward-reverse motor, and set to wait before returning to the one-side path in the housing by a forward rotation of the second forward-reverse motor, and during the time the sheet of recording paper is waiting, another sheet of recording paper is fed to the one-side path in the housing from a paper cassette.

A 26th aspect of the present invention adopts, in the recording apparatus of the 25th aspect, a constitution where while a second sheet of recording paper is taken in a side of the both-side path by a forward rotation of the first forward-reverse motor, the first sheet of recording paper waiting before returning to the one-side path is provided to the one-side path in the housing by the reverse rotation of the second forward-reverse motor, thereafter the second sheet of recording paper taken in the both-side path is drawn in the inversion section by the forward rotation of the second forward-reverse motor, and the first sheet of recording paper fed from the both-side path to the one-side path is discharged from the discharge outlet of the both-side path by a reverse rotation of the first forward-reverse motor.

A 27th aspect of the present invention adopts, in the recording apparatus of the 26th aspect, a constitution where the second sheet of recording paper is drawn out of the inversion section by the reverse rotation of the second forward-reverse motor, and set to wait before returning to the one-side path in the housing.

According to these constitutions, in the case where two sheets of recording paper are fed to the both-side path to perform the successive recording, the two forward-reverse motors are switched to control the feeding position of each recording paper, whereby it is possible to correct the position as appropriate even if either recording paper is ahead or behind than expected on the way, and thereby it is possible to continue the proper circulation of the recording paper.

BRIEF DESCRIPTION OF THE DRAWINGS

The above and other objects and features of the invention will appear more fully hereinafter from a consideration of the following description taken in connection with the accompanying drawing wherein one example is illustrated by way ample, in which.

DETAILED DESCRIPTION OF THE PREFERRED EMBODIMENT

One embodiment of the present invention will be described specifically below with reference to accompanying drawings.

Figure 1:
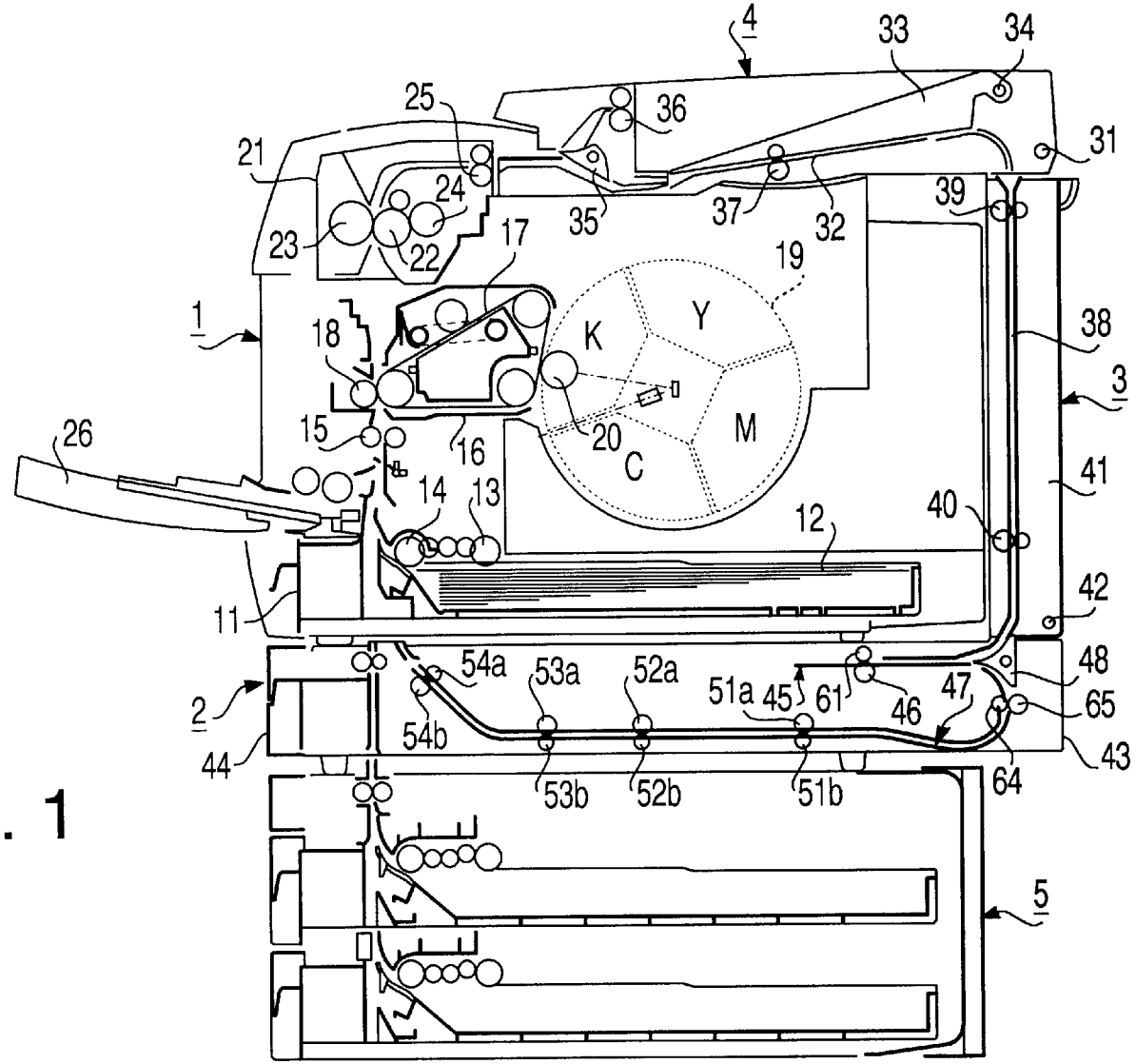
FIG. 1 is a perspective diagram of a recording apparatus according to one embodiment of the present invention.

FIG. 1 is a perspective diagram illustrating an entire structure of a recording apparatus according to one embodiment of the present invention. The recording apparatus illustrated in FIG. 1 is comprised of main body unit 1 composing a main body of the apparatus, inversion unit 2 attached under a bottom of main body unit 1, rear unit 3 attached to an outer rear of main body unit 3, top unit 4 attached on a top of main body unit 1, and paper feed unit 5 further installed under a bottom of inversion unit 2.

In main body unit 1, processing for feeding paper, and transfer, recording and fixing of images is performed. Paper cassette 11 is located on the bottom, and can be drawn forward from main body 1. Pick-up roller 13 picks up a top sheet of recording paper of recording paper bunch 12 in paper cassette 11. The recording paper picked up from paper cassette 11 is fed to resist roller 15 by feed roller 14. Transfer unit 16 is located forward of resist roll 15 in a paper feeding direction. Transfer unit 16 has transfer film 17 on which four toner images with respective colors are deposited. Process unit 19 is located adjacent transfer unit 16. Process unit 19 is provided with four process cartridges for respective colors. An image with a corresponding color is formed on photoconductive material 20 provided in each cartridge. Four images with respective colors formed using the four process cartridges for respective colors are formed on the same position on transfer film 17. Transfer unit 16 transfers the image formed on transfer film 17 to the recording paper with transfer roller 18. At this point, resist roller 15 controls an adjustment of positions of transfer film 17 and a top end of the recording paper. The recording paper with the image transferred thereto is provided from transfer unit 16 to fixing unit 21. Fixing unit 21 is provided with fixing roller 22, pressurizing roller 23 located opposite to fixing roller 22, cleaning roller 24 that coats an oil to enable remaining toners on fixing roller 22 to be removed easily. Fixing roller 22 applies a heat to a recording surface of the recording paper, and pressurizing roller 24 presses the recording paper against fixing roller 22, whereby an image is fixed on the recording paper. Discharge roller 25 is provided at an outlet of fixing unit 21. A paper path from an edge, at a paper feeding side, of paper cassette 11 to discharge roller 25 in fixing unit 21 is referred to as one-side path. In addition, "26" denotes a cover used to put the recording paper by hand, and FIG. 1 illustrates the cover that is opened.

An automatic both-side unit is formed of inversion unit 2, rear unit 3, and top unit 4 respectively located under the bottom, on the outer rear, and on the top of main body unit 1. The automatic both-side unit inverts the recording paper with an image recorded on one side thereof to record another image on a reverse side thereof, and conveys the recording paper to an inlet of the one-side path. A paper path formed in the automatic both-side unit is referred to as both-side path.

The both-side path is thus formed along the outer edge (top, rear and bottom) of main body unit 1 where the one-side path is not overlapped, and thereby it is possible to eliminate areas in which the one-side path and the both-side path overlap, and further to construct a paper jam removing mechanism of the both-side path without superposing a paper jam removing mechanism of the one-side path.

Top unit 4 is attached to the top of main body unit 1. Top unit 4 rotates on rotation shaft 31 to enable the top of main body unit 1 to be opened. Meanwhile, paper path 32 is formed inside top unit 4. Top unit 4 has cover 33 to open an upper side of paper path 32. Cover 33 rotates on rotation shaft 34. The upper surface of cover 33 is used as discharge paper tray when the automatic both-side unit is installed. An inlet of top unit 4 is in the vicinity of a discharge opening of main body unit 1. Switching pawl 35, provided at the inlet of top unit 4, delivers recording paper discharged from the discharge opening of main body unit 1 to a discharge paper tray side or a paper path 31 side (automatic both-side unit side). The recording paper delivered to the discharge paper tray side is discharged to the discharge paper tray (upper surface of cover 33) with discharge roller 36. The recording paper delivered to the paper path 32 side is fed to a rear unit 3 side with feed roller 37.

Rear unit 3 is attached to the rear of main body unit 1. Paper path 38, connected to paper path 32 in top unit 4, is formed inside rear unit 3. A pair of feed rollers 39 and another pair of feed rollers 40 are provided respectively at upper and lower portions along paper path 38, which is placed between the rollers of each pair. Rear unit 3 is separated into two portions along paper path 38. A separated portion operates as cover 41. Cover 41 rotates on rotation shaft 42 to expose paper path 38. The recording paper passed through paper path 38 in rear unit 3 is led to inversion unit 2.

Inversion unit 2 is attached under the bottom of main body unit 1. Inversion unit 2 is provided with drawer frame 43 with the same shape as the bottom of main body unit 1 and with no front surface, drawer 44 stored in drawer frame 43. Draw-in path 45, to which the recording paper that is not inverted is drawn in, is formed to connect to paper path 38 in rear unit 3. Forward-reverse roller 46 is located on draw-in path 45. Forward-reverse roller 46 draws the recording paper fed from rear unit 3 into draw-in path 45, while feeding the recording paper once drawn into draw-in path 45 in the reverse direction. In other words, the recording paper, drawn into drawn-in path 45 from a top end thereof, is drawn out from a rear end thereof. Further inversion path 47 is formed that turns over the recording paper drawn out with the rear end thereof by 180 degrees to invert an upside and downside of the paper. Guide 48 is provided at a branch point of draw-in path 45 and inversion path 47. Guide 48 guides the recording paper fed from rear unit 3 to be drawn into draw-in path 45, while guiding the recording paper drawn out from draw-in path 45 to inversion path 47. In inversion path 47, roller groups (51*a*, 51*b*), (52*a*, 52*b*) and (53*a*, 53*b*) each with an inclination correction function described later are located. The outlet of the paper path formed inside inversion unit 2 (draw-in path 45 and inversion path 47) is connected to an inlet of the one-side path in main body unit 1. In other words, the recording paper inverted in the both-side path is returned to the one-side path.

As described above, circulating the both-side path along the outer edge of main body unit 1 increases straight portions of the path, while reducing sharp angle bend areas of the path, and thereby it is possible to form a structure with a paper jam hardly occurring. Further since it is possible to form the both-side path utilizing spaces available outside the apparatus effectively, it is possible to facilitate the installation of the both-side path when the path is an option.

Figure 2:
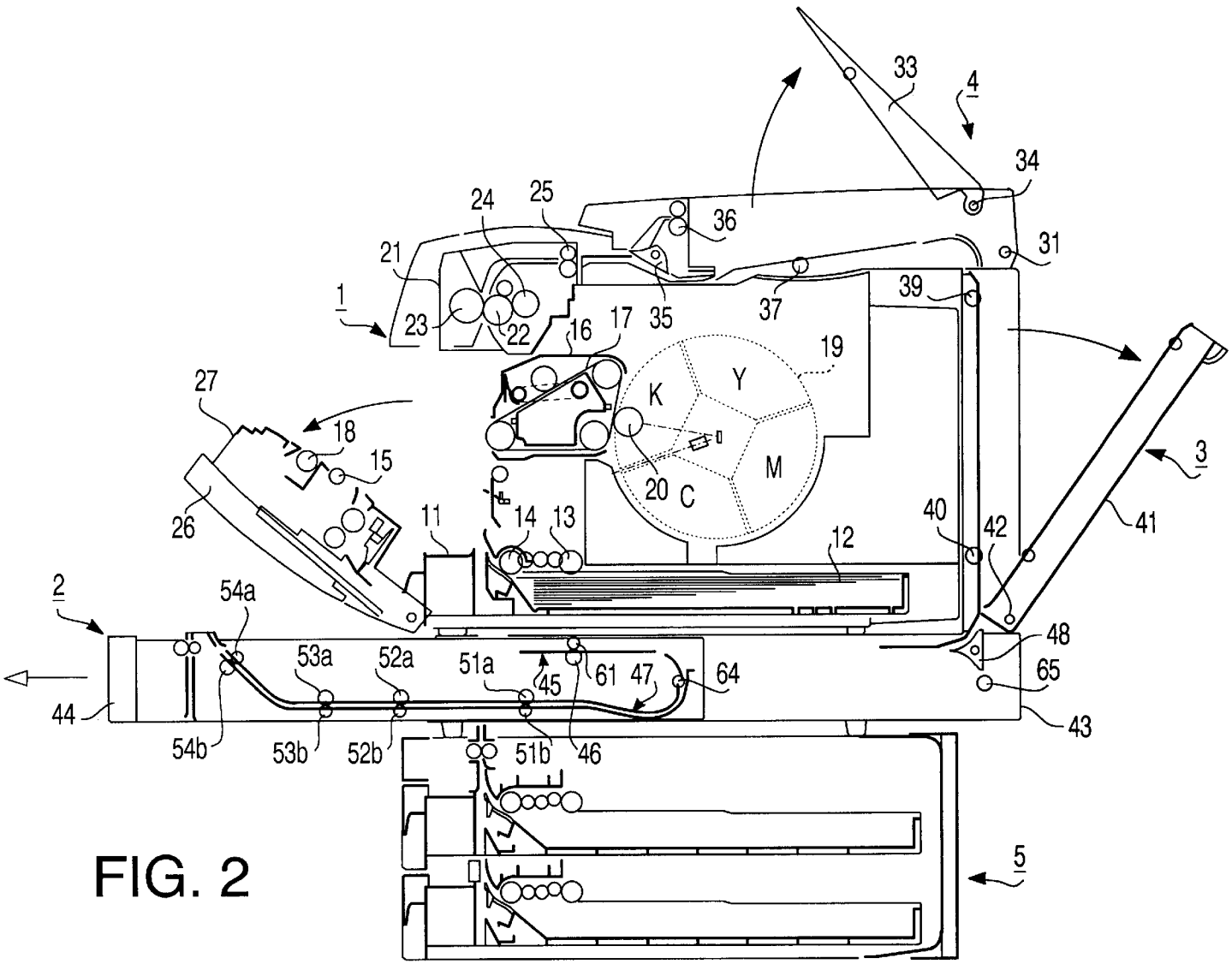
FIG. 2 is a perspective diagram of the recording apparatus of the above embodiment with paper jam removing mechanisms thereof opened.

The following explains the removing mechanisms to remove paper jams occurring on the one-side path and both-side path. FIG. 2 illustrates the recording apparatus with all the removing mechanisms provided on the one-side path and both-side path opened.

The removing mechanism for the one-side path is cover 27 provided at a front side of the housing composing main body unit 1. Cover 27 is supported in the vicinity of the bottom of main body unit 1 with rotation shaft 28. Opening cover 27 exposes the one-side path from the outlet of paper cassette 11 to the inlet of fixing unit 21.

A first removing mechanism among the removing mechanisms for the both-side path is cover 33 to remove a paper jam occurring in top unit 4. The paper jam occurs on paper path 32 in top unit 4. When cover 33 is opened, almost the entire paper path 32 in top unit 4 is exposed. A paper jammed on paper path 32 in top unit 4 can be removed easily by opening cover 33.

Figure 3:
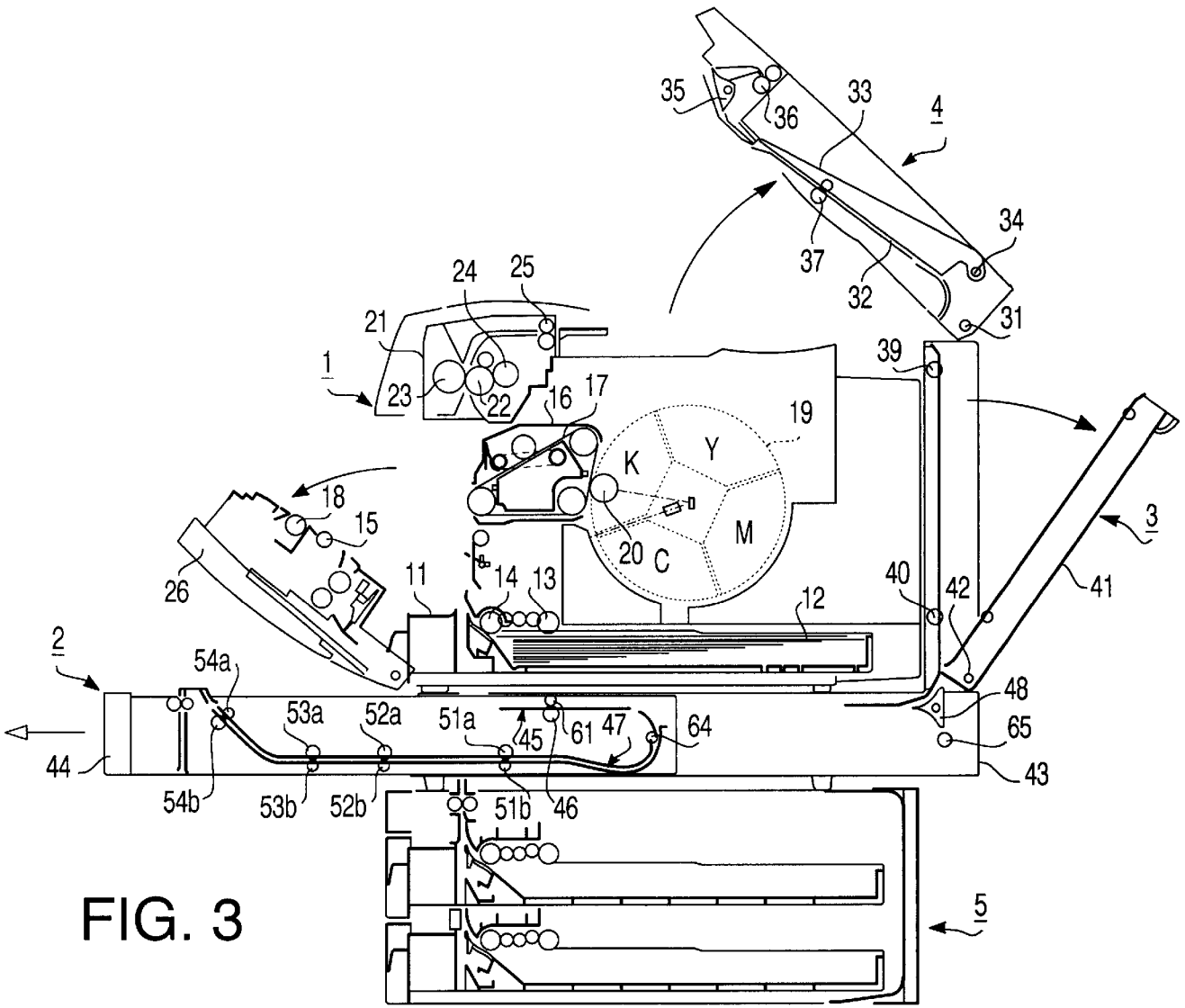
FIG. 3 is another perspective diagram of the recording apparatus of the above embodiment with the paper jam removing mechanisms thereof opened.

Further when the paper jam occurs between an outlet section of the one-side path and an inlet section of the both-side path, opening cover 33 to expose paper path 32 in top unit 4 finds out no recording paper to be removed because the paper is not fed to top unit 4 yet. The above-mentioned top unit 4 is attached to main body unit 1 circularly movably by rotation shaft 31. As illustrated in FIG. 3, when top unit 4 rotates on rotation shaft 31 as a supporting point, top unit 4 itself separates from the top of main body unit 1, whereby a portion between the outlet section of the one-side path and the inlet section of the both-side path can be exposed, and thereby the jammed recording paper can be removed easily.

Another removing mechanism among the removing mechanisms for the both-side path is composed of cover 41 to remove a paper jam occurring in rear unit 3. Cover 41 is supported to be opened and shut by rotation shaft 42 present at a lower portion in rear unit 3. When cover 41 is opened, almost the entire paper path 38 in rear unit 3 is exposed. A paper jammed on paper path 38 in rear unit 3 can be removed easily by opening cover 41.

The other removing mechanism among the removing mechanisms for the both-side path is drawer 44 to remove a paper jam occurring in inversion unit 2. The inversion mechanism is mainly comprised of draw-in path 45, inversion path 47, forward-reverse rotation roller 46, roller groups 51 to 54, and a guide described later. Since the inversion mechanism is stored in drawer 44, the inversion mechanism is drawn outside when drawer 44 is drawn out, whereby the paper jam can be removed easily.

The removing mechanisms are thus provided separately corresponding to straight areas (bottom, rear and top) of the both-side path not to expose at one time all the areas of the both-side path formed by being circulated along the outer edge of main body unit 1. It is thereby possible to expose only a required portion of the straight areas each with a relatively simplified structure comprised of only the rollers and guide without complicated metal plates, facilitating the paper jam removing operation.

Further, all the removing mechanisms are not covers, and the removing mechanism in the bottom of the both-side path is comprised of the drawer, whereby it is possible to further install optional paper cassette 5 under the both-side path. Thereby it is possible to prevent the installation of the both-side path from limiting the installation of the paper cassette, and to achieve the paper jam removal on the both-side path.

Furthermore, the recording paper is inverted at the final path of the both-side path that is the closest to the area where the recording paper is returned to the one-side path, and thereby it is possible to provide the inversion portion, where the paper jam and position shift tend to occur, in the vicinity of the one-side path. Therefore even in the case where the removing mechanisms for the one-side path and those for the both-side path are provided separately, it is possible to remove the paper jam in the section of the both-side path where the paper jam and position shift tend to occur, in an area which is not away from the removing mechanism of the one-side path, and thus to prevent the removing mechanisms from being present in different areas of the apparatus, as possible.

Figure 4A:
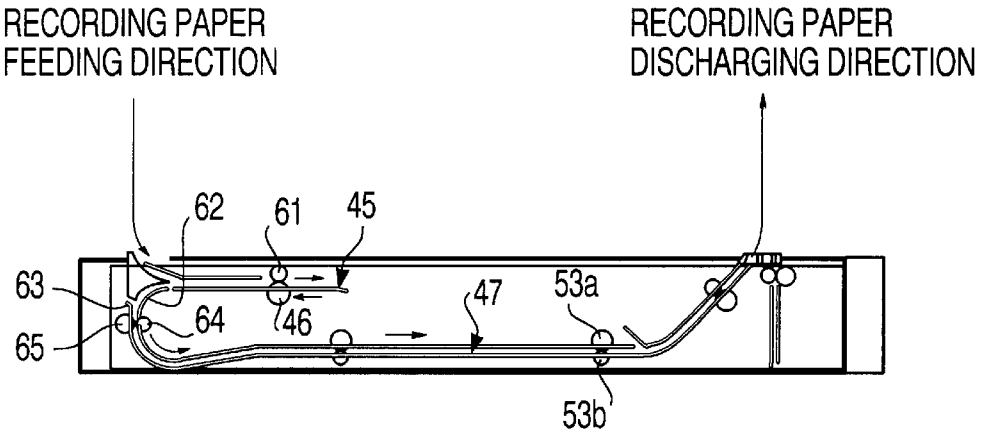
FIG. 4A is a perspective diagram illustrating only an inversion unit in the above embodiment.
Figure 4B:
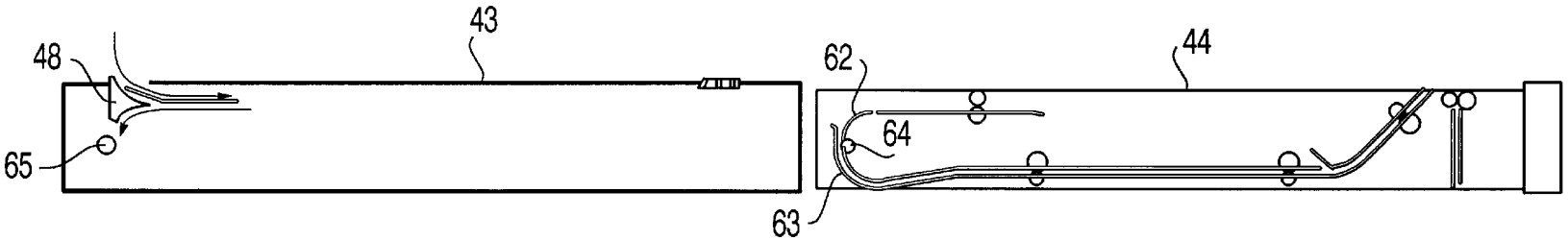
FIG. 4B is a perspective diagram illustrating the inversion unit and a drawer pulled from the unit.
Figure 5:
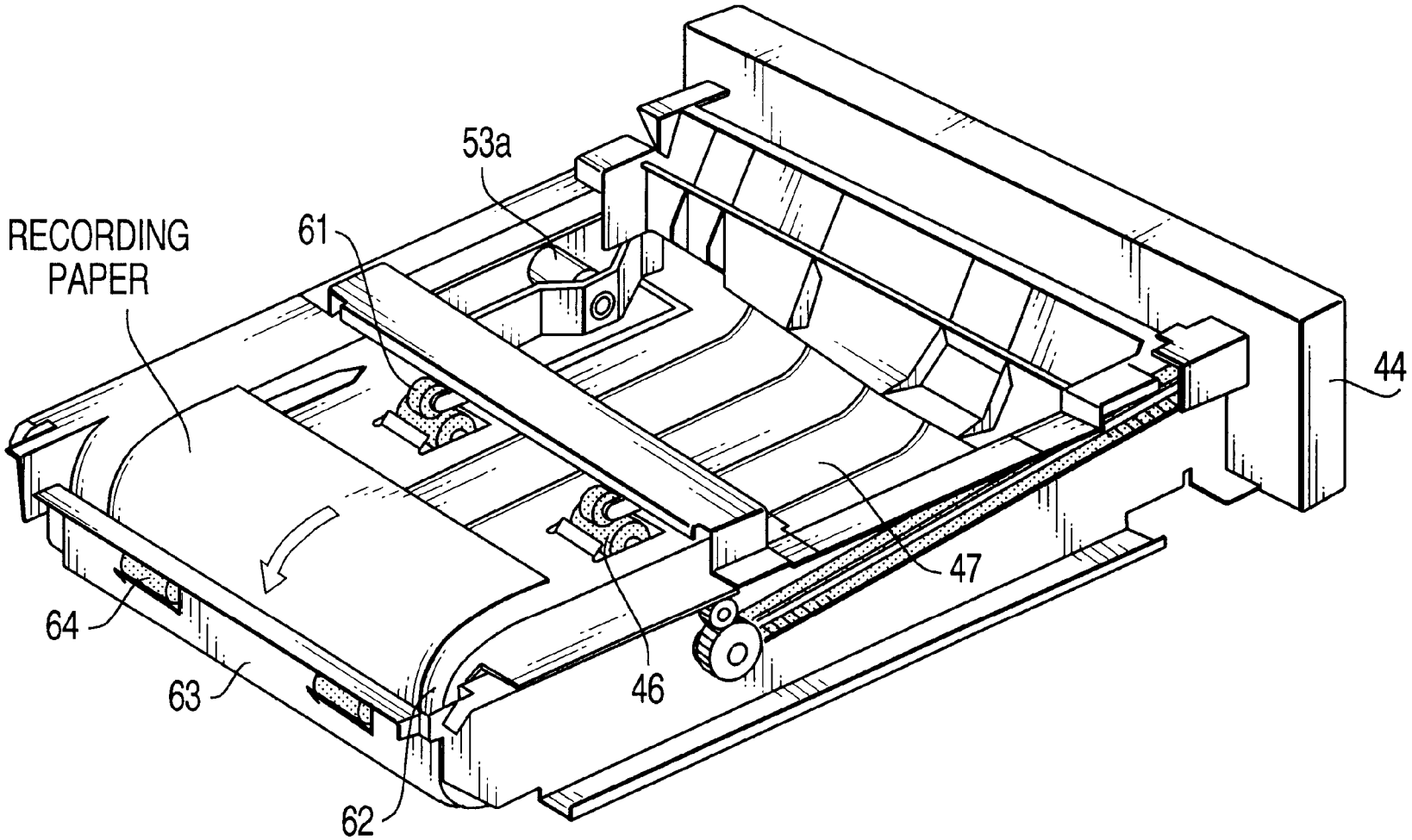
FIG. 5 is a perspective view of the inversion unit in the above embodiment.

The following specifically explains a structure of inversion unit 2. FIG. 4A is a perspective diagram of inversion unit 2. FIG. 4B is a perspective diagram illustrating drawer frame 43 and drawer 44 that is completed drawn out from drawer frame 43. Further FIG. 5 is a perspective view of drawer 44.

Pinch roller 61 is provided opposite to forward-reverse roller 46 of draw-in path 45. The roller 46 and pinch roller 61 put the recording paper entering draw-in path 45 therebetween, and thereby rotation power of the roller 46 can be transferred to the recording paper. A pair of guides 62 and 63 in the form of a semicircle is provided in an area where the recording paper, which is drawn into draw-in path 45 and then drawn out of the path 45 with the end edge, is inverted. Guides 62 and 63 have respective openings at areas opposite to each other. Feed roller 64 is exposed to a side of the paper path through the opening of guide 62. Pinch roller 65 is exposed to the side of the paper path through the opening of guide 63 to be pressed against feed roller 64. The inversion mechanism, which inverts the recording paper entering inversion unit 2 and returns the paper to the one-side path again, is comprised of draw-in path 45, forward-reverse roller 46, inversion path 47, guides 63 and 64, and roller groups (51 to 53). As illustrated in FIG. 4B, almost all the members composing the inversion mechanism are provided in drawer 44, and a small number of such members such as guide 48 and pinch roller 65 are attached to drawer frame 43.

Thus the removing mechanism of the bottom of the both-side path is comprised of drawer frame 43 and drawer 44, and the inversion mechanism is provided in drawer 44, whereby when drawer 44 is drawn out, the inversion mechanism is drawn out together. Therefore it is possible to remove the paper jam occurring in the inversion mechanism, where the paper jam tends to occur the most frequently, easily with an easy operation.

In the above-mentioned inversion mechanism, forward-reverse roller 46 and pinch roller 61 feed the recording paper while putting the paper therebetween in draw-in path 45. Accordingly when the paper jam occurs in draw-in path 45, drawing drawer 44 results in that the recording paper held between the rollers (46 and 61) is drawn out along with drawer 44, whereby it is possible to remove the jammed paper assuredly from the inversion mechanism.

Further the above-mentioned inversion mechanism is provided with guide 62 that guides one side of the recording paper and guide 63 that guides the other side of the recording paper in the area where the recording paper is inverted by 180 degrees. Therefore when the paper jam occurs in the area where the recording paper is inverted by 180 degrees, drawing out drawer 44 results in that the recording paper held between the guides (62 and 63) is drawn out. Accordingly even in the case where it is not possible to provide the inversion mechanism with a pair of rollers it is possible to remove the jammed paper assuredly from the inversion mechanism.

Furthermore the above-mentioned inversion mechanism is provided with the guide (62 or 63) that guides one side of the recording paper and the roller (65 or 65) that feeds the other side of the recording paper, whereby drawing out drawer 44 results in that the recording paper held by the guide (62 or 63) is drawn out along with drawer 44. Therefore even in the case where one roller (64) is arranged in the inversion mechanism, and another roller (65) is arranged in a drawer frame side, it is possible to remove the lammed paper from the inversion mechanism assuredly.

Moreover in the above-mentioned inversion mechanism, the recording paper is put between the guides (62 and 63) or the rollers (64 and 65) with both sides thereof in an innermost portion in drawer 44. Therefore in the case where the paper jam occurs in the innermost portion in drawer 44, it is possible to draw the jammed recording paper out of drawer frame 43 assuredly with the paper put between the guides or rollers, as a result it is possible to prevent an operator from performing the complicated operation to remove the jammed paper while stretching the operator's hand to the innermost portion in drawer frame 43 that stores drawer 44.

Further inversion unit 2 is provided under the bottom of main body unit 1, so that the recording paper is inverted at the final path of the both-side path that is the closest to the area where the recording paper is returned to the one-side path. It is thus possible to provide the inversion section, where the paper jam and position shift tend to occur, in the vicinity of the one-side path. Therefore even in the case where the removing mechanisms for the one-side path and the removing mechanisms for the both-side path are provided separately, it is possible to remove the paper jam in the section where the paper jam and position shift tend to occur, in an area which is not away from the removing mechanism of the one-side path, and thus to prevent the removing mechanisms from being present in different areas of the apparatus, as possible.

In addition the both-side path has a long total length because the path circulates along the outer edge of the main body unit 1. In a paper path with a long total length, when recording paper skews at a first stage of the path, the degree of skew becomes larger at a final stage of the path. In particular in the both-side path, the recording paper tends to skew at the first stage where the recording paper passed through the one-side path is taken in the both-side path, because a top edge of the paper tends to miss the position at such a portion. It is necessary to prevent the occurrence of the skew of the recording paper which may cause the paper jam.

Figure 6:
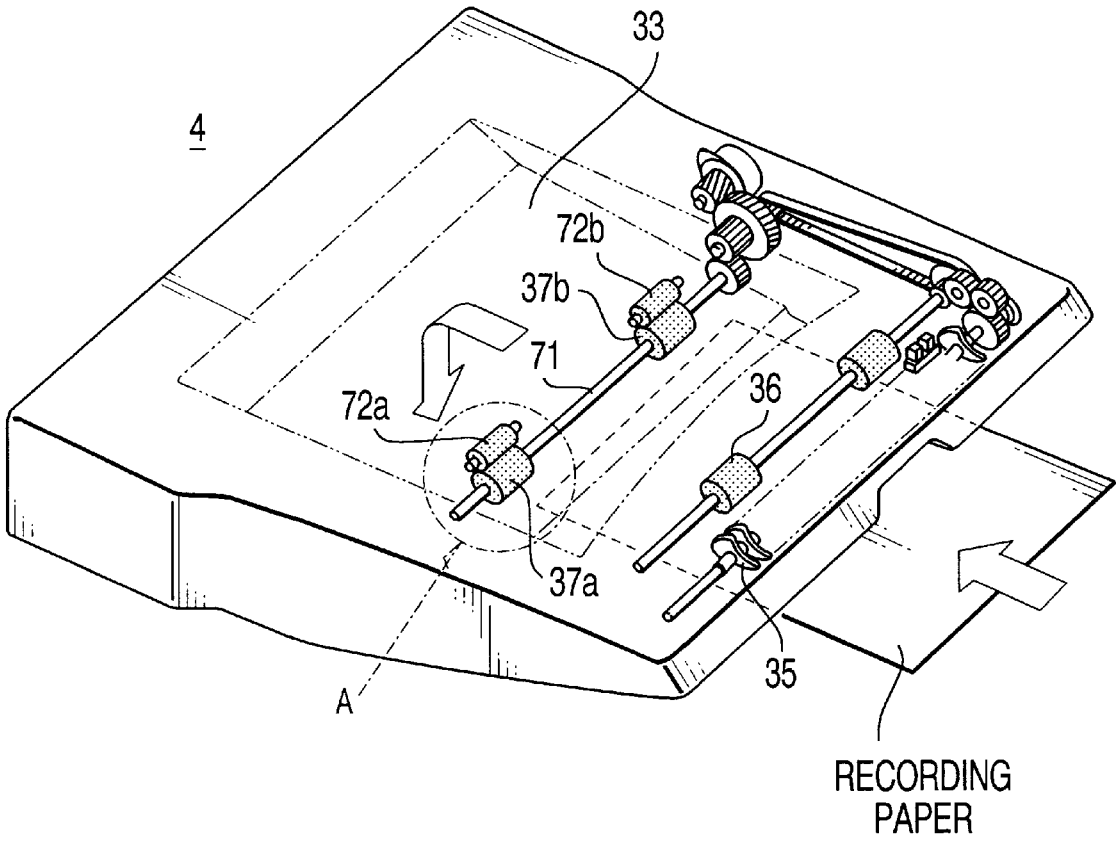
FIG. 6 is a perspective view of a top unit in the above embodiment.

In this embodiment, it is designed to prevent the pinch rollers from causing inclination pressures to the feed rollers in top unit 4. FIG. 6 illustrates a perspective view of top unit 4. Feed rollers 37*a* and 37*b* are attached to shaft 71 with the rollers spaced apart by a distance corresponding to the width of the recording paper. Pinch rollers 72*a* and 72*b* are provided respectively opposite to feed rollers 37*a* and 37*b*.

Figure 7:
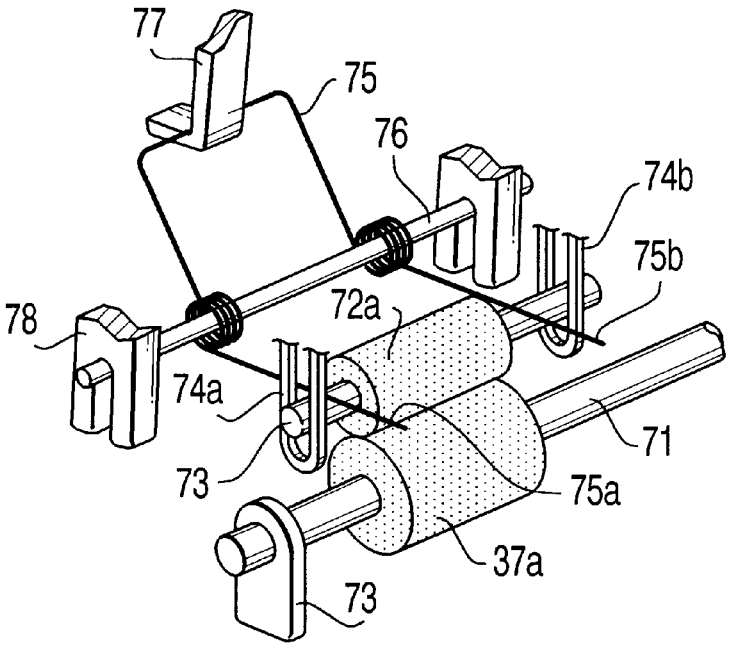
FIG. 7 is a perspective view of a roller holding mechanism in the above top unit.

FIG. 7 is a perspective view illustrating a mechanism to hold pinch roller 73*a*. Both end of shaft 71 with feed rollers 37*a* and 37*b* attached thereto are each fixed to the housing of top unit 4 through shaft holder 72. Meanwhile both end of shaft 73 with pinch rollers 72*a* and 72*b* attached thereto are respectively inserted into guides 74*a* and 74*b* each opening upwardly in the general form of a U. Guides 74*a* and 74*b* are fixed to cover 33 at fixing points thereof. When pinch roller 72*a* is lowered to a position where pinch roller 72*a* is in contact with feed roller 37*a*, shaft 73 of pinch roller 72*a* is spaced away from the lowest position of guides 74*a* or 74*b* by a predetermined distance. The mechanism for holding pinch roller 72*a* has pressuring spring 75 that presses shaft 73 of pinch roller 72*a* against the feed roller side at positions spaced from the opposite sides of pinch roller 72*a*. Pressuring spring 75 is in the general form of a U, a middle portion of the spring is wounded on support shaft 76, and two straight springs 75*a* and 75*b* extending in parallel from support shaft 76 press independently opposite sides of shaft 73 of pinch roller 72*a* arranged between the springs. The opposite ends of support shaft 76 are limited in their upward movement by shaft holder 78 opening downwardly. Meanwhile a closed portion of the general form of a U of pressuring spring 75 is hung on holding member 77 in the general form of an L.

Figure 8:
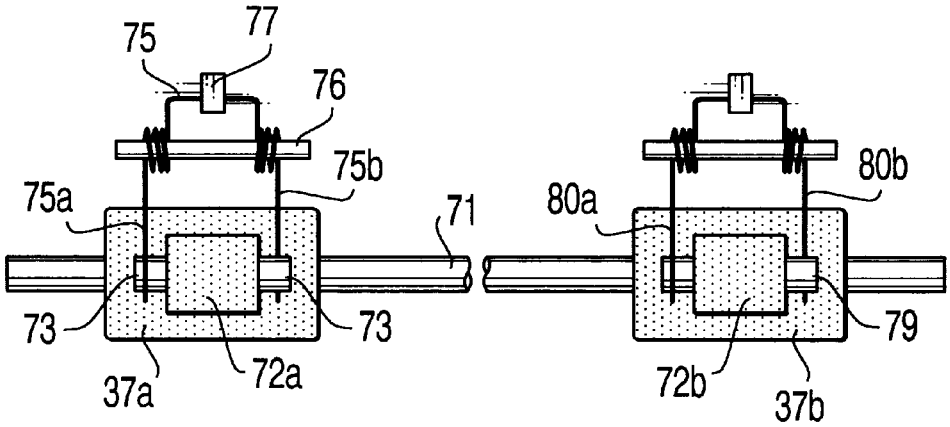
FIG. 8 is a front view of the above roller holding mechanism.

FIG. 8 is a plan view illustrating the above-mentioned hold mechanism viewed in the direction in which the recording paper enters. As illustrated in FIG. 8, another holding mechanism to hold pinch roller 72*b* is also configured in the same way as in the holding mechanism for pinch roller 72*a* so that two straight springs 80*a* and 80*b* press independently opposite sides of shaft 79 of pinch roller 72*b* arranged between the springs.

There are thus provided pinch rollers 72*a* and 72*b* of which shafts 73 and 79 are pressed at respective opposite sides thereof independently so that pinch rollers 72*a* and 72*b* are in contact respectively with feed rollers 37*a* and 37*b*. As a result, it is possible to prevent pinch rollers 72*a* and 72*b* from pressing feed rollers 37*a* and 37*b* ununiformly not to cause contact inclination thereto, therefore to prevent the recording paper from skewing at the first stage of the both-side path, and consequently to prevent an image from being recorded askew in the recording section.

Further the recording apparatus of this embodiment is provided with system to prevent the occurrence of the skew of the recording paper, in rear unit 3 and inversion unit 2. Rear unit 3 is provided with an inclination mechanism that inclines the recording paper forcibly in a predetermined direction, and inversion unit 2 is provided with a skew correction mechanism that has a correction function for a skew in the predetermined direction.

Figure 9:
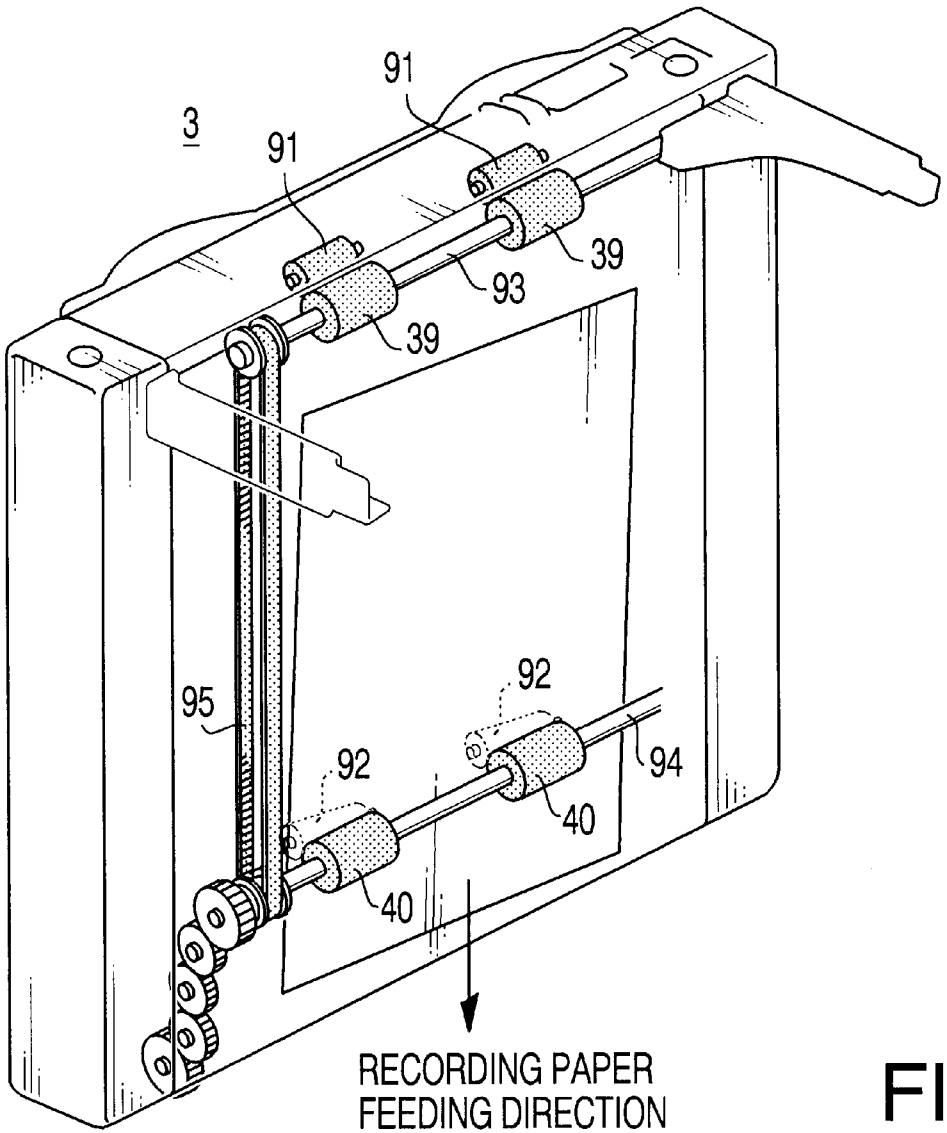
FIG. 9 is a perspective view of a rear unit in the above embodiment.

FIG. 9 is a perspective view of rear unit 3 as seen from the attachment surface side. On paper path 38 in rear unit 3, pinch rollers 91 are provided opposite to feed rollers 39 arranged at the upper side, and pinch rollers 92 are provided opposite to feed rollers 40 arranged at the lower side. Pinch rollers 91 and 92 are attached to cover 41. Pinch rollers 91 are arranged in parallel with feed rollers 39 opposite to pinch rollers 91 to apply uniform pressures to feed rollers 39. Meanwhile skew pinch rollers 92 are arranged inclined to feed rollers 40 opposite to pinch roller 92 each at a predetermined angle. In other words, skew pinch rollers 92 are arranged to cause contact inclination to the recording paper taken in between skew pinch rollers 92 and feed rollers 40. Thereby the recording paper passed through paper path 38 in rear unit 3 is provided to inversion unit 2 with the paper inclined purposely in a specific direction. In addition, belt 95 is laid in a tensioned condition between shaft 93 with feed roller 39 attached thereto and shaft 94 with feed roller 40 attached thereto, whereby feed roller 39 rotates in the same direction as feed roller 40 synchronously.

Figure 10:
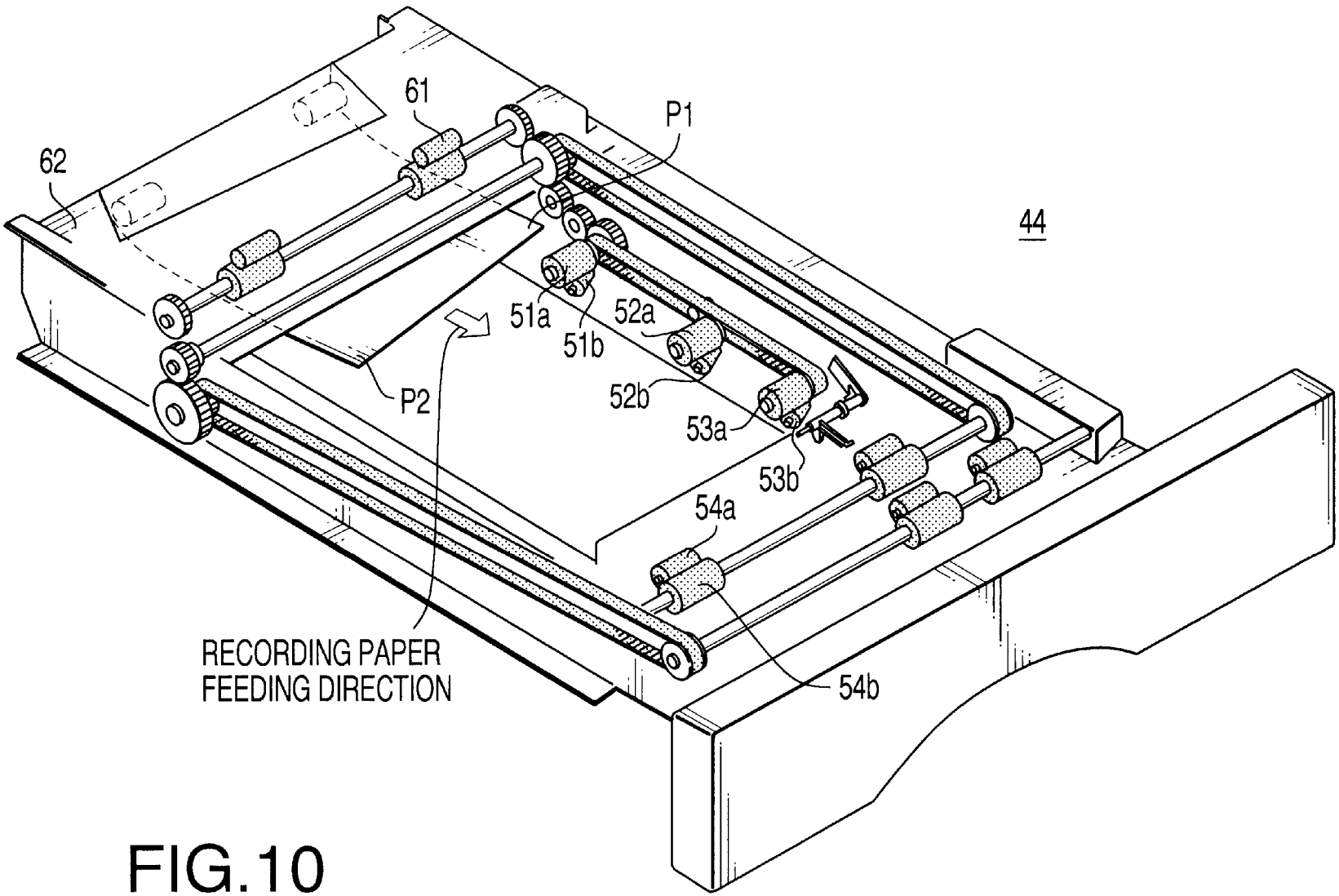
FIG. 10 is a perspective view of the inversion unit in the above embodiment.

FIG. 10 is a perspective view of drawer 44 of inversion unit 2 as seen from above. Feed rollers 51*a* to 53*a* are supported with a recording paper guide mechanism described later. Incineration correction pinch rollers 51*b* to 53*b* are provided respectively opposite to feed rollers 51*a* to 53*a*. Inclination correction pinch rollers 51*b* to 53*b* are arranged for feed rollers 51*a* to 53*a* opposite to the pinch rollers, respectively. Further inclination correction pinch rollers 51*b* to 53*b* are inclined at respective predetermined angles in a direction in which the skew correction function is available to correct the skew of the recording paper inclined in the predetermined direction.

Figure 11:
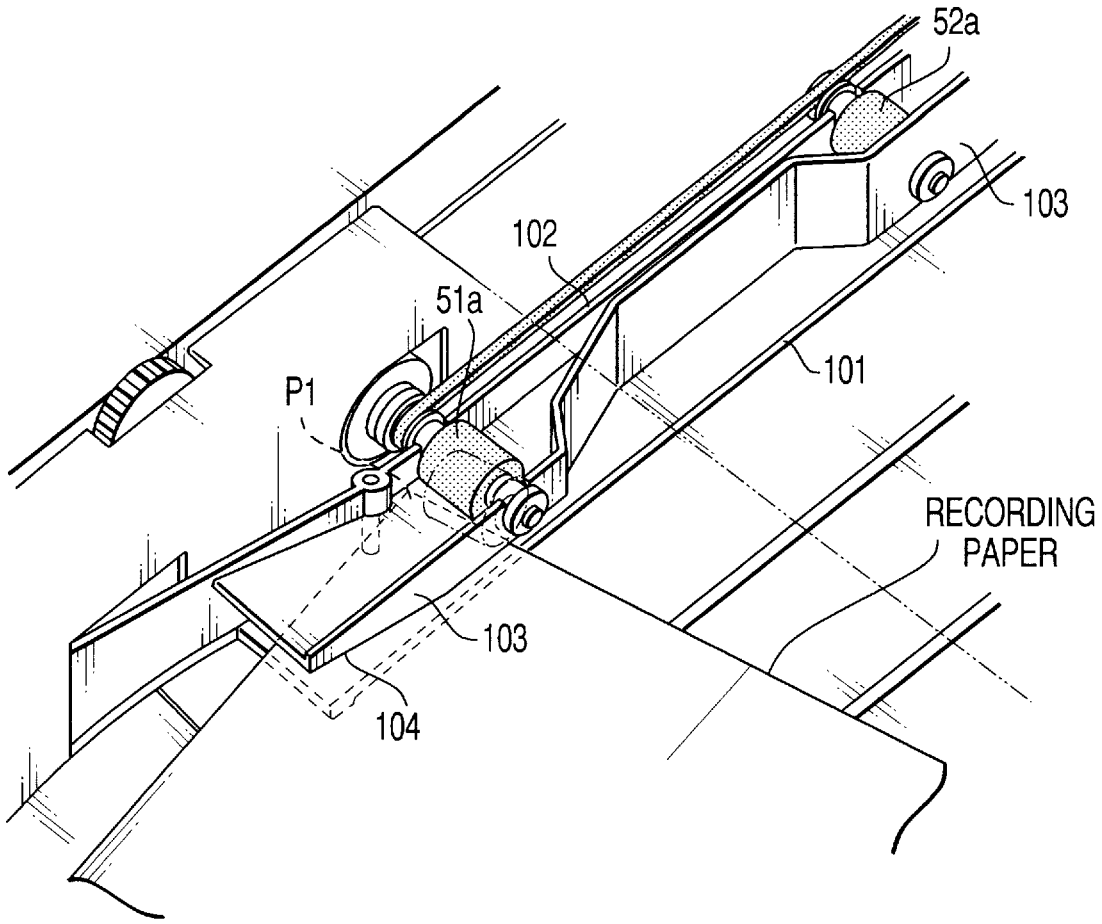
FIG. 11 is a partially perspective view of a skew correction mechanism in the above inversion unit.

FIG. 11 illustrates a partially perspective view of the above-mentioned recording paper guide mechanism. The recording paper guide mechanism is provided along an inner surface in the vicinity of the bottom of drawer 44. The recording paper guide mechanism has lower guide plate 101 with openings formed therein to expose part of inclination correction pinch rollers 51*b* to 53*b* on inversion path 47, side guide plate 102 standing up vertically to lower guide plate 101 from a side surface of lower guide plate 101 to form a reference surface, and upper guide member 103 with openings, arranged spaced above lower guide plate 101, formed therein to expose feed rollers 51*a* to 53*a* on inversion path 47. Upper guide member 103 is provided with bearings formed therein which hold one sides of the shafts of respective feed rollers 51*a* to 53*a*, and has areas with longer widths between the plate 102 and the member 103, in which the openings for feed rollers 51*a* to 53*a* are formed. Upper guide member 103 has taper surface 104 formed at a paper entering portion which the inverted recording paper fed to a bottom side of drawer 44 first enters. Taper surface 104 enables the recording paper to smoothly enter between lower guide plate 101 and upper guide member 103. Further an end portion of side guide plate 102 is folded outwardly to form a guide in a taper shape, enabling side guide plate 102 to catch top end corner P1 of the recording paper that enters inclined to assuredly lead to the reference surface.

Figure 12:
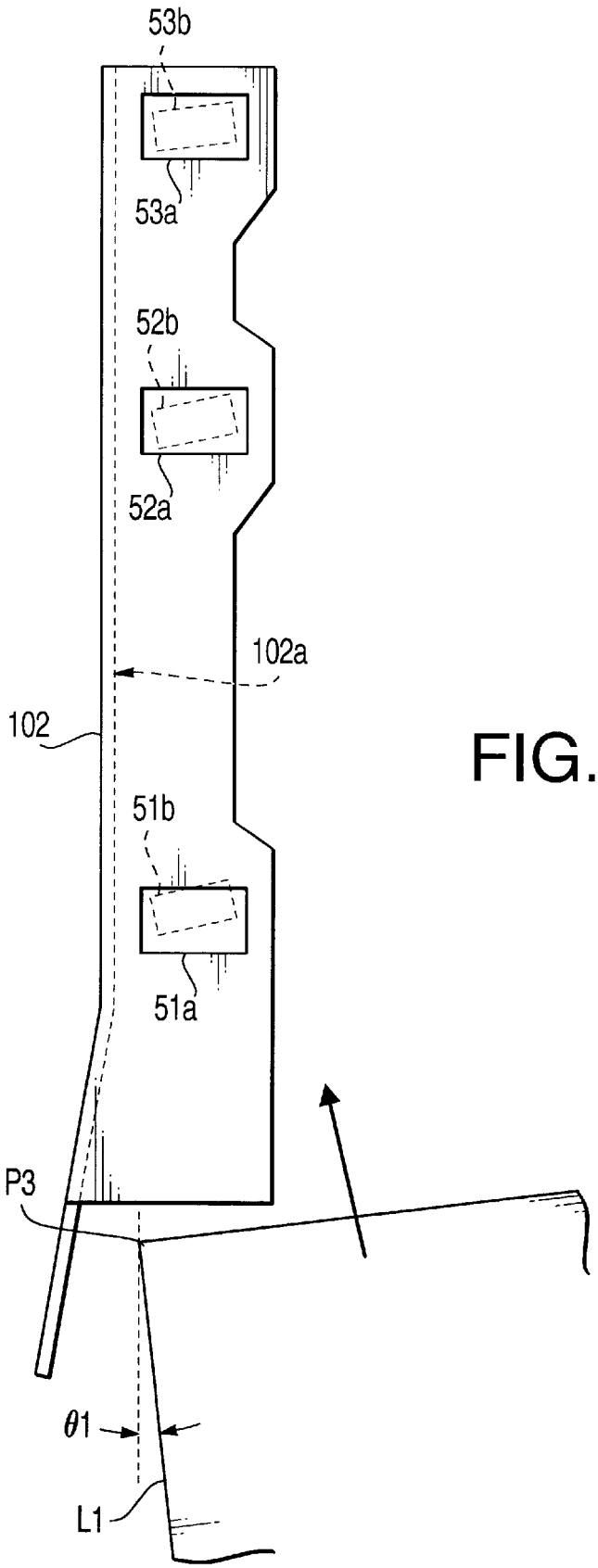
FIG. 12 is a plan view of the above skew correction mechanism as seen from above.

With reference to FIG. 12, the following explains the relationship between angles of inclination correction pinch rollers 51*b* to 53*b* and directions in which the skew is corrected. Feed rollers 51*a* to 53*a* are attached so that rotation shafts thereof are vertically to reference surface 102*a*, which is parallel with the paper entering direction and formed on side guide plate 102. Meanwhile with respect to inclination correction pinch rollers 51*b* to 53*b*, rotation shafts thereof are arranged inclined at respective different predetermined angles to respective rotation shafts of feed rollers 51*a* to 53*a*, on a plane vertical to reference surface 102*a*, which is parallel with another plane on which the rollers 51*a* to 53*a* are present. Further the predetermined angles are made smaller gradually in the order of inclination correction pinch rollers 51*b* to 53*b*, where pinch roller 51*b* is first in contact with the recording paper, and pinch roller 53*b* is last in contact with the recording paper.

As illustrated in FIG. 12, it is desired that the recording paper be inclined in the same direction as the inclination direction of the inclination correction pinch roller (51*b*, 52*b* or 53*b*) immediately before entering the above-mentioned skew correction mechanism. FIG. 12 illustrates a condition that the recording paper is inclined at θ1 to reference surface 102*a*. When the recording paper skewing under the above condition enters the skew correction mechanism, the skew of the recording paper is corrected effectively.

In order to set the recording paper entering the skew mechanism to be inclined in the direction illustrated in FIG. 12, feed roller 40 and inclination pinch roller 92 incline the recording paper in an arbitrary direction in advance in rear unit 3.

Figure 13A:
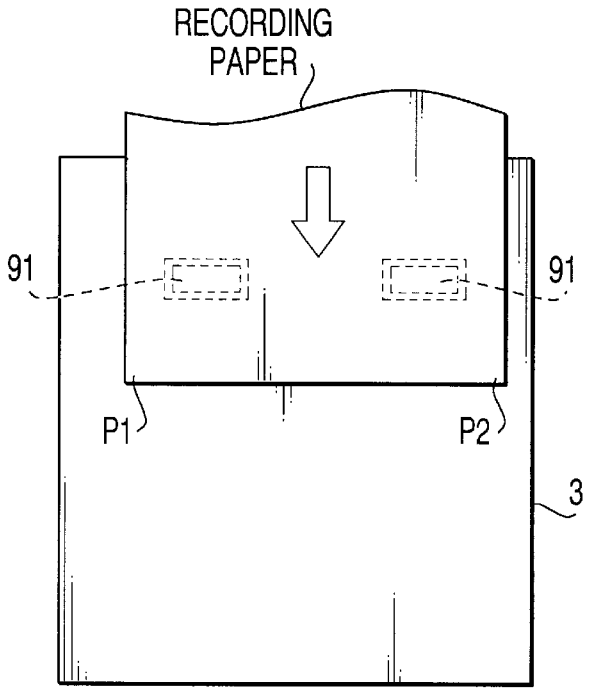
FIG. 13A is a diagram illustrating recording paper entering the rear unit without skewing.
Figure 13B:
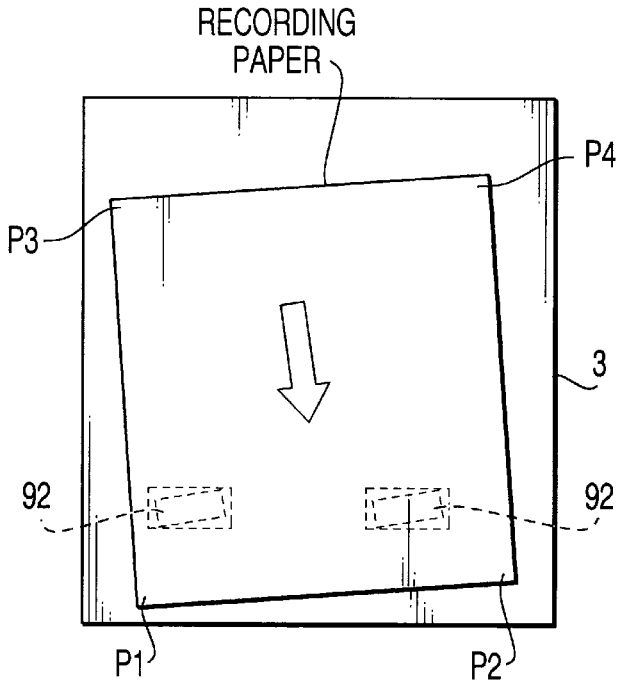
FIG. 13B is a diagram illustrating recording paper entering the rear unit while skewing.

With reference to FIGS. 13 and 14, the following explains how to correct the skew of the recording paper in rear unit 3 and inversion unit 2. The recording paper passed through the one-side path, with an image recorded on one side thereof, is taken in the both-side path in top unit 4, and further provided from top unit 4 to rear unit 3. FIG. 13A illustrates the recording paper entering rear unit 3 from top unit 4. The recording paper does not skew at this point.

In rear unit 3, the recording paper fed by feed roller 39 is taken in between another feed roller 40 and inclination pinch roller 92 without skewing. The rotation shaft of inclination pinch roller 92 rotates while being inclined at such an angle that the right-hand portion is inclined slightly upwardly as viewed in FIG. 13*b*, on a plane parallel with the feeding surface in rear unit 3. Accordingly the recording paper is inclined so that left top end P1 goes forward further than right top end P2. Thus the recording paper is inclined in the arbitrary direction forcibly in rear unit 3.

The recording paper entering inversion unit 2 from rear unit 3 is next led to draw-in path 45. The recording paper led to draw-in path 45 is drawn in the inner portion in draw-in path 45 by forward-reverse roller 46 and pinch roller 61 while being inclined. The draw-in direction is illustrated with an arrow in solid line in FIG. 14A. FIG. 15 is a perspective view of drawer 44 with the recording paper drawn in draw-in path 45.

As illustrated in FIG. 15, when the recording paper is drawn in draw-in path 45 until the rear end of the recording path is completely away from guide 48, the rotation direction of forward-reverse roller 46 is reversed. As a result, the recording paper drawn in draw-in path 45 is pushed out in the opposite direction from the rear end thereof. The recording paper pushed out in the opposite direction is guided to enter between a pair of guides 62 and 63 each in the form of a semicircle by guide 48. The recording paper entering between the pair of guides 62 and 63 each in the form of the semicircle is pushed out by feed roller 65 and pinch roller 64 to an inversion path 47 side. FIG. 5 illustrates the recording paper entering between the pair of guides 62 and 63 each in the form of the semicircle.

Figure 14A:
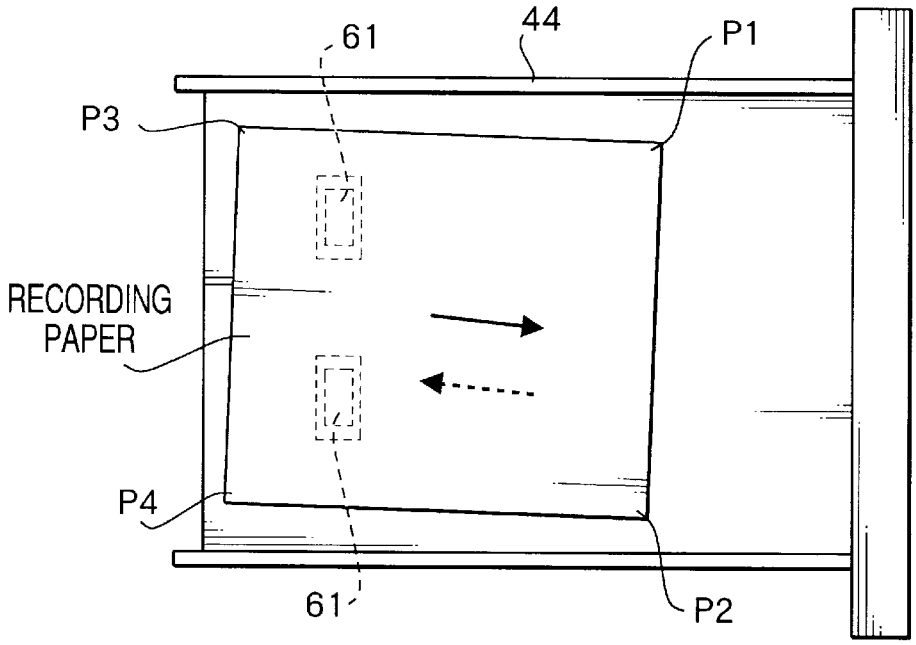
FIG. 14A is a diagram illustrating recording paper entering the inversion unit before being inverted.
Figure 15:
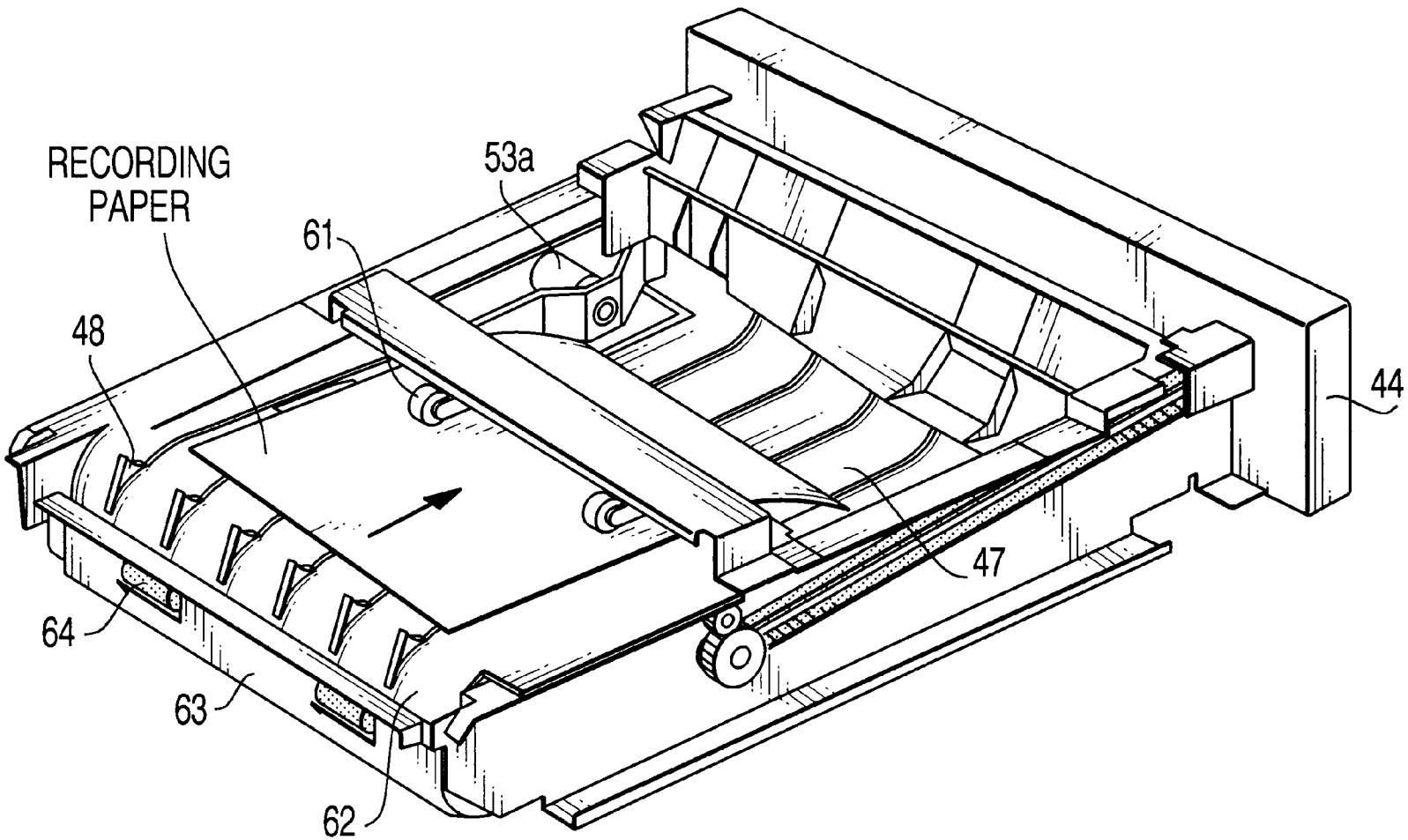
FIG. 15 is a perspective view of the inversion unit with recording paper drawn in a draw-in path.

The recording paper, pushed out in the opposite direction by forward-reverse roller 46 in inversion path 45, moves in the direction shown with an arrow in broken line in FIG. 14A. In other words, the top end and rear end of the recording paper are reversed, and a portion used to be the top end and another portion used to be the rear end until the paper is pushed out respectively become the rear end and top end. Since the recording paper is inclined so that P1 goes forward further than P2 before the paper moving direction is reversed, P4 goes forward further than P3 present on the same side as P1 after the paper moving direction is reversed.

Figure 14B:
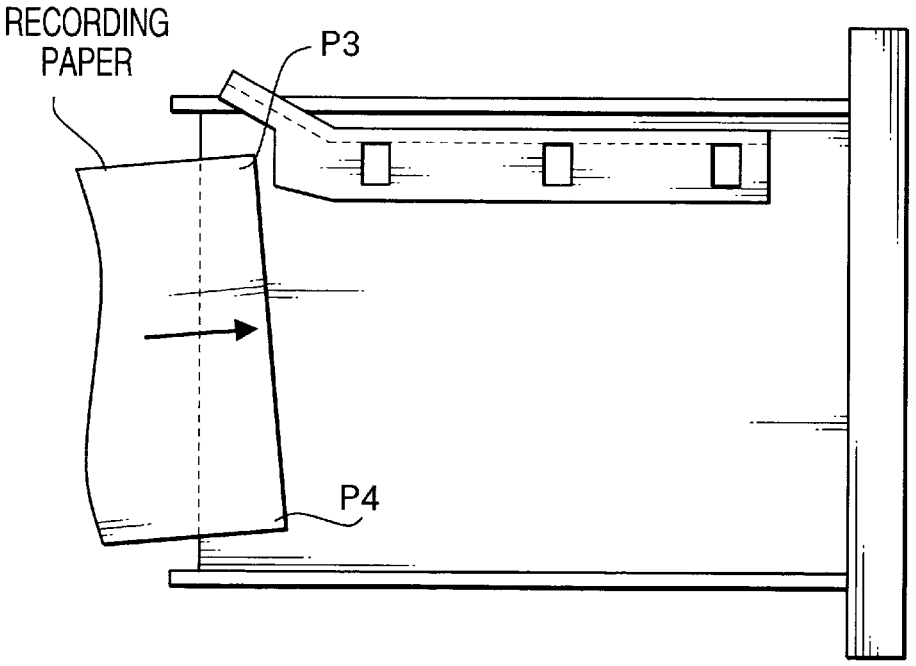
FIG. 14B is a diagram illustrating recording paper entering the inversion unit after being inverted.

The recording paper inverted by 180 degrees by the pair of guides 62 and 63 each in the form of the semicircle enters inversion path 47 at one side of which the skew correction mechanism is located. As described above, since the recording paper moves inclined so that P3 goes forward further than P4, the recording paper is inclined as illustrated in FIG. 14B when arrives at an inlet of the skew correction mechanism. As described above, this inclination is desired for the skew correction mechanism to correct the skew.

The recording paper entering the skew correction mechanism with such an inclination is fed by feed roller 51*a* and inclination correction pinch roller 51*b*, while top end P3 thereof is in contact with reference surface 102*a*. The recording paper is next passed through between feed roller 52*a* and inclination pinch roller 52*b*, and further passed through between feed roller 53*a* and inclination correction pinch roller 53*b*, whereby the skew of the recording paper is corrected so that a side edge of the recording paper is parallel to reference surface 102*a*.

Thus, circulating the both-side path along the outer edge of main body unit 1 makes the total length of the both-side path longer, and as the length becomes longer, the skew tends to occur. However, on the assumption that the skew is present, the direction of the recording paper is inclined forcibly in the direction that the skew correction mechanism expects, and then fed to the skew correction mechanism, whereby it is possible to correct the skew of the recording paper assuredly, and to feed the recording paper with the straight direction to a recording section.

Further as compared to a mechanism in which the skew correction mechanism is moved to the recording paper, the structure of this embodiment does not require a process to stop the feed of recording paper once, or move the skew correction mechanism, and it is thereby possible to perform the skew correction in the process in which the recording paper is fed originally, and therefore to prevent the occurrence of time loss.

To incline the direction of the recording paper in the direction that the skew correction mechanism expects, rear unit 3 and the inversion mechanism (draw-in path 45, forward-reverse roller 46, guides 62 and 63 and others) are utilized, whereby it is possible to correct the direction of the recording paper with a simplified configuration while feeding the recording paper without stopping the feed.

The recording apparatus according to this embodiment is comprised of main body unit 1, inversion unit 2, rear unit 3 and top unit 4 as described above, and further these units are constructed in a separable way.

Figure 16:
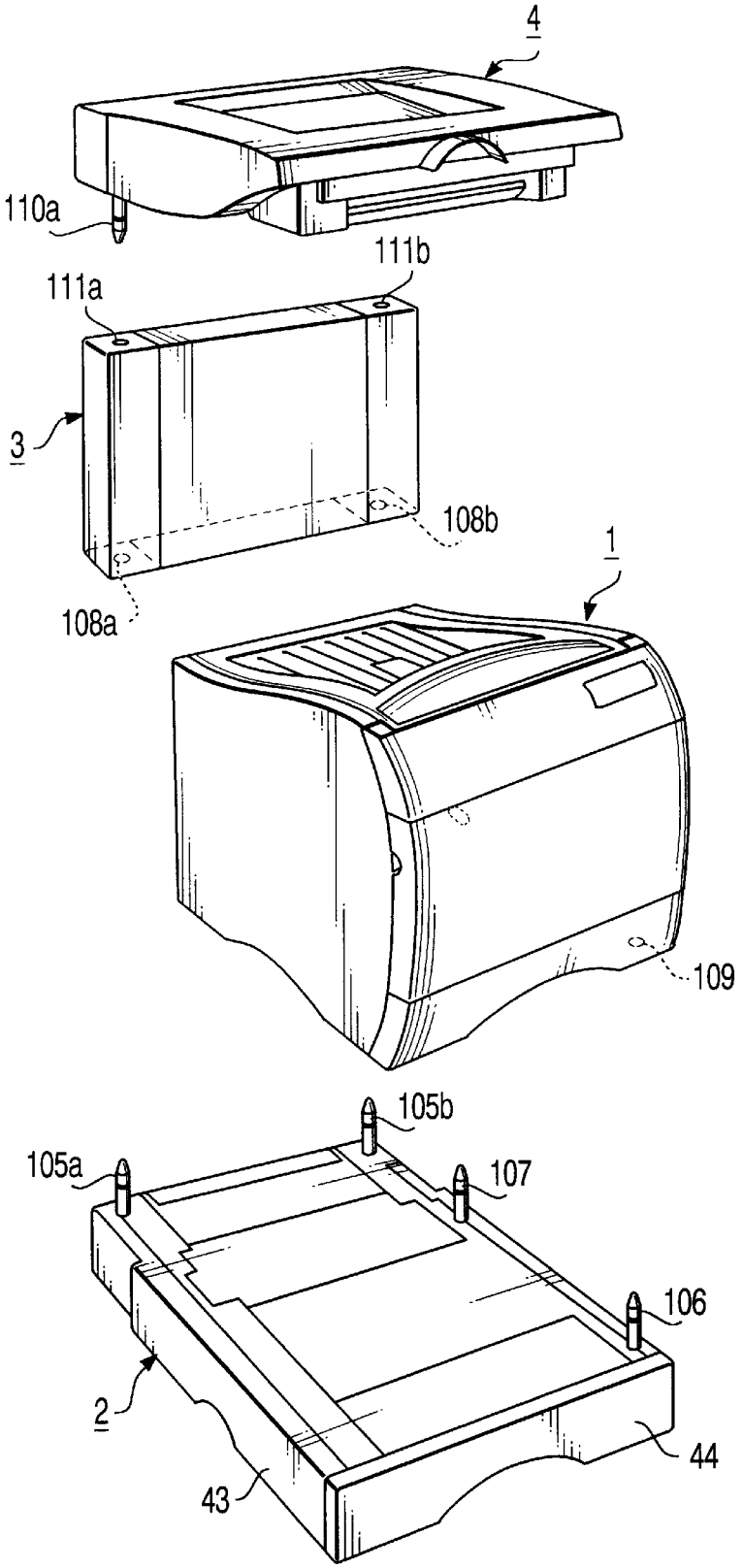
FIG. 16 is a disassembled perspective view of the recording apparatus according to this embodiment.

FIG. 16 illustrates a disassembled perspective view of main body unit 1, inversion unit 2, rear unit 3 and top unit 4 composing the recording apparatus.

Fix pins 105*a* and 105*b* for use in attaching rear unit 3 are arranged in standing conditions at opposite sides in the rear end of drawer frame 43 of inversion unit 2. Further fix pin 106 for use in attaching main body unit 1 is arranged in a standing condition at one 14 side at the top end of drawer frame 43, and furthermore another fix pin 107 for use in attaching main body unit 1 is arranged in a standing condition at the same side as fix pin 106.

Pin guides 108*a* and 108*b* are formed at corresponding positions on lower end surface of rear unit 3 to insert fix pins 105*a* and 105*b* thereto. Fix pins 105*a* and 105*b* are respectively inserted into pin guides 108*a* and 108*b*, whereby rear unit 3 is assembled at the rear end of inversion unit 2.

Further pin guides 109 (pin guide corresponding to fix pin 107 is not shown in the figure) are formed at corresponding positions at the lower surface of main body unit 1 to insert fix pins 106 and 107 respectively thereto. Fix pins 106 and 107 are inserted into corresponding pin guides 109, whereby main body unit 1 is fixed to a predetermined position on an upper surface of inversion unit 2.

Moreover a pair of fix pins 110*a* (another pin is not shown in the figure) are arranged in standing conditions at the rear end of the lower surface of top unit 4. Meanwhile pin guides 111*a* and 111*b* are formed at corresponding positions on an upper end surface of rear unit 3 to insert fix pins 110*a* thereto. Fix pins 110*a* are inserted into corresponding pin guides 111*a* and 111*b*, whereby top unit 4 is attached on main body 1 circularly movably using the rear end thereof as a supporting point.

Figure 17:
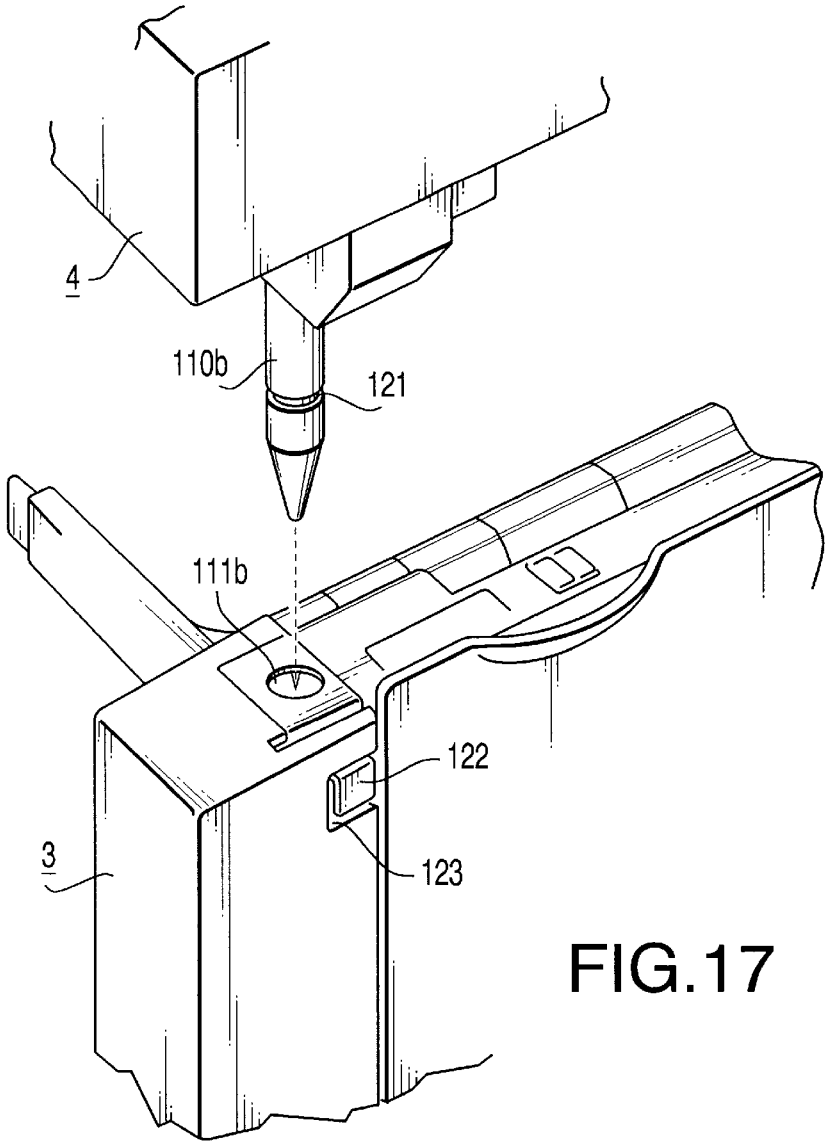
FIG. 17 is a perspective view illustrating the top unit with a fixed pin and the rear unit with a pin guide before the pin is inserted into the pin guide.
Figure 18:
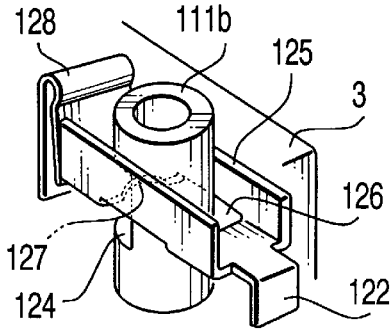
FIG. 18 is a perspective view illustrating a structure of the pin guide.

With reference to FIGS. 17 and 18, the following explains specific structures of the fix pins and pin guides. FIG. 17 is a perspective view of the upper end surface of rear unit 3 on which the pin guide is formed, and the rear end portion of top unit 4 on which the fix pin is provided. Fix pin 110*b* is provided with a sharpened tip to be smoothly inserted into pin guide 111*b*. Further fix pin 110*b* is provided with groove 121 for lock throughout the periphery at a middle portion thereof. Meanwhile rear unit 3 is provided with lock lever 122 on the outer surface thereof in the vicinity of pin guide 111*b*. On the outer surface of rear unit 3, space 123 used to push lock lever 122 therein is formed at a portion at which lock lever 122 is provided.

FIG. 18 illustrates a lock mechanism provided in rear unit 3. Pin guide 111*b* is comprised of a material in the form of a cylinder with an inner diameter that is slightly larger than an outer diameter of fix pin 110*b*. Pin guide 111*b* is provided with a notch put in the vicinity of the center axis formed on a side surface opposed to the side surface opposed to lock lever 122. Engagement member 125 with a cross section in the general form of a U has a bottom with a width that is slightly larger than the outer diameter of pin guide 111*b*. Pin guide 111*b* is inserted into opening 126 formed by cutting a portion of the bottom of engagement member 125. Engagement member 125 is further provided with semicircular notch 127 formed along the periphery of opening 126 at a position opposed to notch 124 of pin guide 111*b*. Semicircular notch 127 engages with groove 121 of fix pin 110*b*. Semicircular notch 127 of engagement member 125 and groove 121 of fix pin 110*b* has such a relative position relationship that semicircular notch 127 of engagement member 125 is opposed to groove 121 of fix pin 110*b* when the lower surface of top unit 4 is in contact with the upper end portion of rear unit 3. Lock spring 128 is located at the other end of engagement member 125.

In the lock mechanism with the above-described structure, when fix pin 110*b* is inserted into pin guide 111*b*, semicircle notch 127 of engagement member 125 is put around the vicinity of a center portion of pin guide 111*b* through notch 124. Semicircular notch 127, pressed against lock spring 128 by the outer edge of the tip of fix pin 110*b*, is pushed back by a force of lock spring 128. When fix pin 110*b* is further pushed downwardly and comes to such a point that the lower surface of top unit 4 is in contact with the upper end portion of rear unit 3 and therefore the further pin insertion is restricted, semicircular notch 127 applied the force by lock spring 128 engages with groove 121 of fix pin 110*b*. Since engagement member 125 is thus locked to groove 121 of fix pin 110*b*, fix pin 110*b* is not pulled off even if the force is applied to pull top unit 4 upwardly. On the other hand, when lock lever 122 is pushed, semicircular notch 127 moves back, and the lock of fix pin 110*b* and engagement member 125 is released.

While the above description explains the lock mechanism of fix pin 110*b* of top unit 4 and pin guide 111*b* of rear unit 3, the other lock mechanisms of other fix pins (105*a*, 105*b*, 106, 107 and 110*a*) and corresponding pin guides (108*a*, 108*b*, 109, and 111*a*) are constructed in the same way as the above-mentioned lock mechanism.

Since the both-side path is thus constructed with a plurality of units of inversion unit 2 (bottom portion), rear unit 3 (side portion), and top unit 4 (top portion) in a separable way, it is possible to provide the recording apparatus comprised of only main body unit 1 to a user who does not require the both-side path, while providing the recording apparatus enabling both-side recording to another user who requires the both-side path, by later attaching the both-side path along the outer edge of main body unit 1. Further since the both-side path is separated into a plurality of units, it is possible to prepare each unit in the form enabling the easy transportation, and to reduce the weight of each unit. Furthermore since each unit is attached along the outer edge of an housing sequentially to assemble, it is possible to improve the assembling characteristic.

Moreover the fix pins and pin guides to connect units to each other work as positioning materials to determine positions of the units, and fixing materials to connect the units to each other to fix. Therefore the operation to connect the units to each other to fix is completed by the operation to match positions of the units by the positioning materials, and as a result, it is possible to improve the assembling characteristic.

Figure 19:
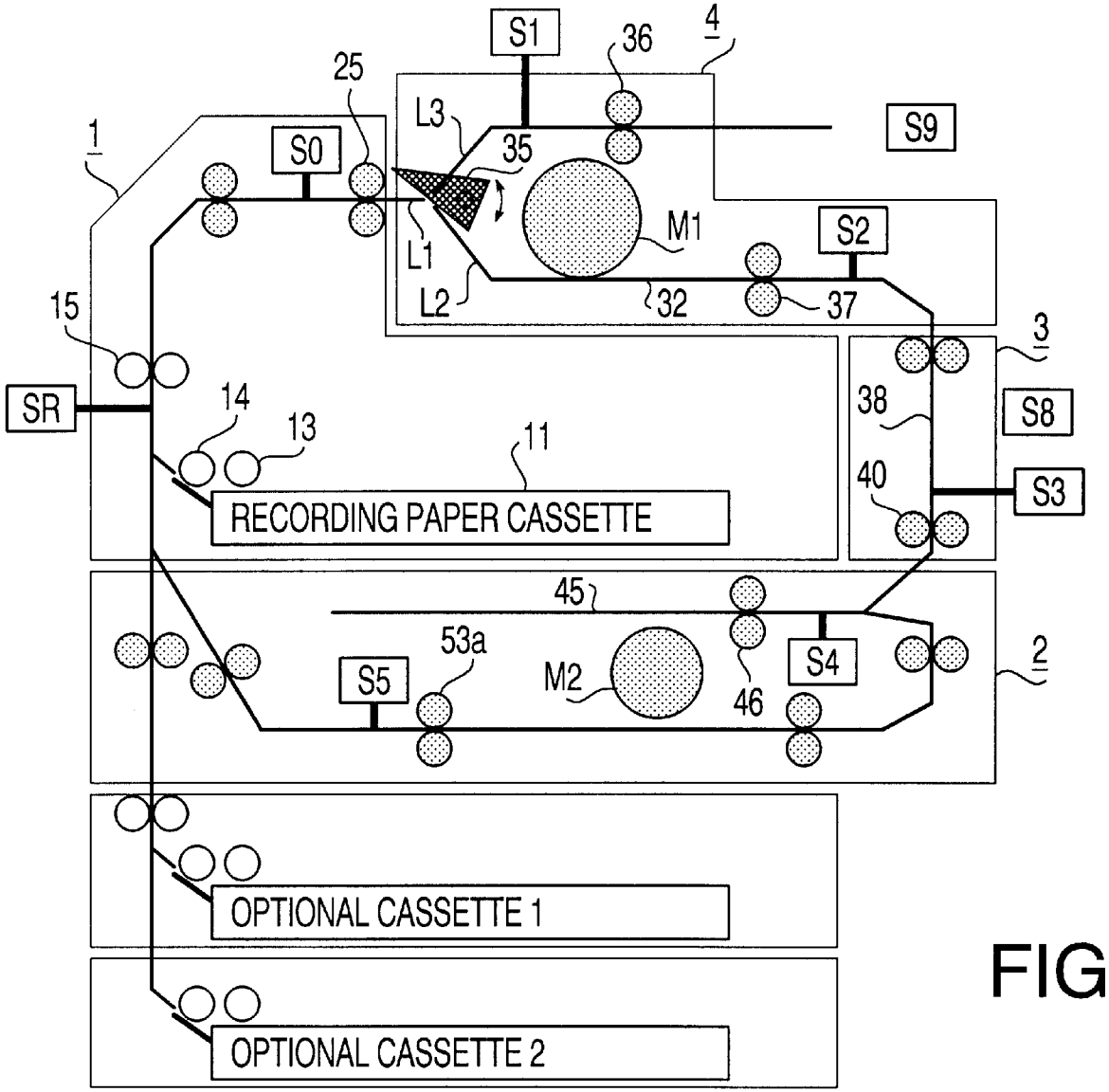
FIG. 19 is a perspective diagram illustrating a driving system and sensor arrangement in the recording apparatus according to the above embodiment.

The following explains the control operation of the recording apparatus according to this embodiment using FIG. 19.

The one-side path formed in main body unit 1 is provided with resist sensor SR directly before resist roller 15, and with main-body discharge sensor So directly before discharge roller 25, in the feeding direction. Resist sensor SR detects the recording paper passed through resist roller 15. Main-body discharge sensor S0 detects the recording paper discharged from fixing unit 2 that is a final outlet of main body unit Top unit 4 is provided with discharge sensor S1 before, in the feeding direction, discharge roller 36 that discharges the recording paper taken in top unit 4 to the discharge tray side. Discharge sensor S1 detects the recording paper discharged to the discharge tray side. Moreover passing sensor S2 is located after, in the feeding direction, feed roller 37 on paper path formed in top unit 4. Further passing sensor S3 is provided before, in the feeding direction, feed roller 40 on paper path 38 formed in rear unit 3. In inversion unit 2, inversion sensor S4 is provided before forward-reverse roller 46 on draw-in path 45, and outlet sensor S5 is provided directly after feed roller 53*a* on inversion path 47, in the feeding direction. In addition, S8 is a sensor to detect whether cover 41 is opened or closed, and S9 is a sensor to detect whether cover 33 is opened or closed.

A plurality of sensors located on the both-side path as described above are arranged at spaced intervals longer than the recording paper length. A control section (not shown in the figure) of the recording apparatus drives all the feed rollers on the both-side path at the initial operation time to judge whether or not the sensors detect the recording paper. When any sensor on the both-side path detects the recording paper, the control section displays a message indicative of that the recording paper remains on the both-side path on a display section not shown in the figure.

Figure 20:
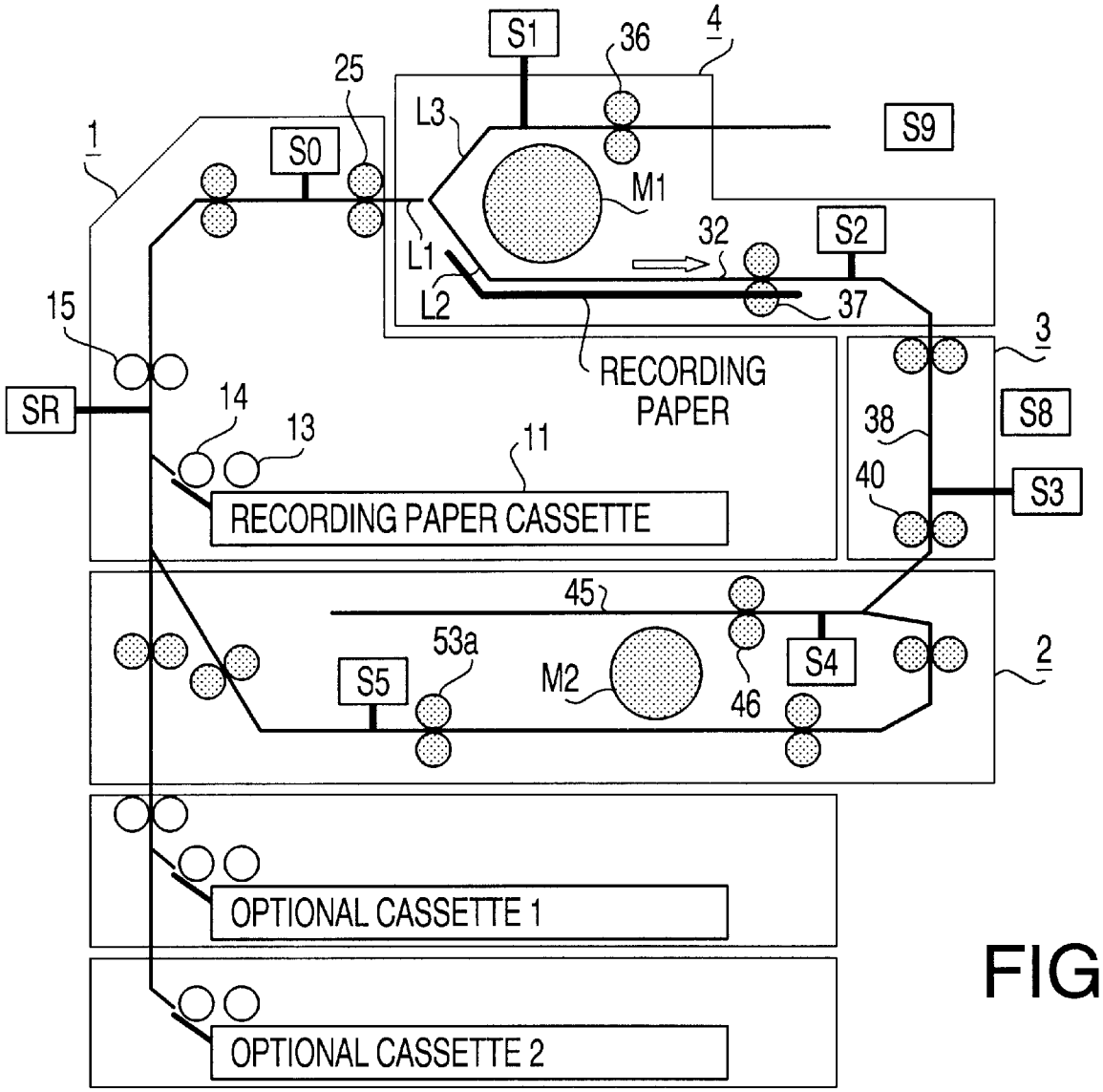
FIG. 20 is a perspective diagram illustrating a relationship between the sensor arrangement and a length of a sheet of recording paper in the above embodiment.

For example, as illustrated in FIG. 20, there is a case that the recording paper lies at such a position that the recording paper is not detected bypassing sensor S2, on paper path 32 in top unit 4. In such a case, when feed roller 37 is rotated at the initial operation time, passing sensor S2 detects the recording paper when the top end of the paper comes to passing sensor S2. When passing sensor S2 is turned on, the control section stops the rotation of feed roller 37, and displays the message indicative of that the recording paper remains on paper path 32. Thereby, a user can removes the remaining paper on the both-side path by opening cover 33. Similarly the rotation of the feed roller is stopped when any of passing sensor S3 in rear unit 3, sensors S4 and S5 in inversion unit 2 is turned on, and thereby it is possible to stop the recording paper at the position corresponding to the paper lam removing mechanism, and to remove the remaining paper easily through the corresponding removing mechanism.

Since the both-side path thus circulated along the outer edge of main body unit 1 increases the total length of the paper path, the number of sensors to be arranged is increased, and consequently the number of components is increased. However sensors are arranged at spaced intervals longer than the recording paper length, and the rollers are driven to feed the recording paper at the initial operation time, whereby the recording paper moves to the sensor when remains on the both-side path. It is thereby possible to suppress an increase of the number of components, and to detect whether or not the recording paper is present on the both-side path assuredly at the initial operation time.

The following explains processing performed when switching pawl 35 in top unit 4 malfunctions. In the case of the automatic both-side recording, the operation of switching pawl 35 is controlled so that the recording paper is led to an inlet side of the both-side path when the recording paper with an image recorded on a first side thereof is taken in top unit 4, and the recording paper is led to the discharge tray side when the recording paper with an image recorded on a second side thereof is taken in top unit 4.

Hereinafter a path connecting the discharge outlet of the one-side path and the inlet of the both-side path is referred to as first path L1, another path that guides the recording paper from first path L1 to the both-side path is referred to as second path L2, and the other path that guides the recording paper from first path L1 to the discharge tray side provided above the both-side path is referred to as third path L3.

The switching direction of switching pawl 35 is controlled by the rotation direction of first forward-reverse motor M1, and the operations of discharge roller 36 and feed roller 37 are also controlled by the rotation direction of first forward-reverse motor M1. When first forward-reverse motor M1 rotates in the forward direction, switching pawl 35 operates to guide the recording paper to second path L2, and feed roller 37 rotates in the direction in which the recording paper is fed to an inversion unit 2 side. On the other hand, when first forward-reverse motor M1 rotates in the reverse direction, switching pawl 35 operates to guide the recording paper to third path L3, and discharge roller 36 rotates in the direction in which the recording paper is fed to the discharge tray.

Figure 21:
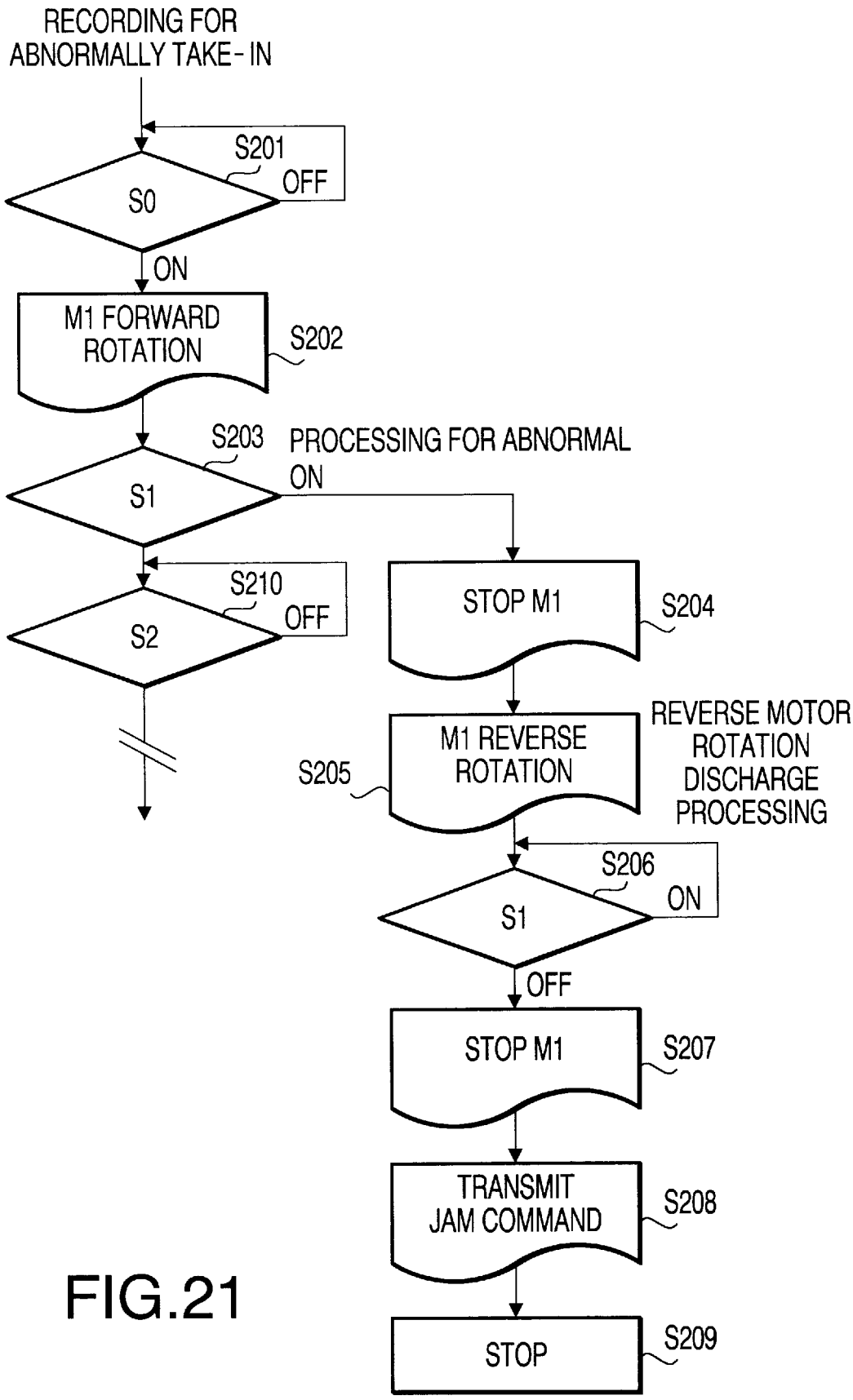
FIG. 21 is a flow diagram for abnormal take-in processing in the above recording apparatus.
Figure 22:
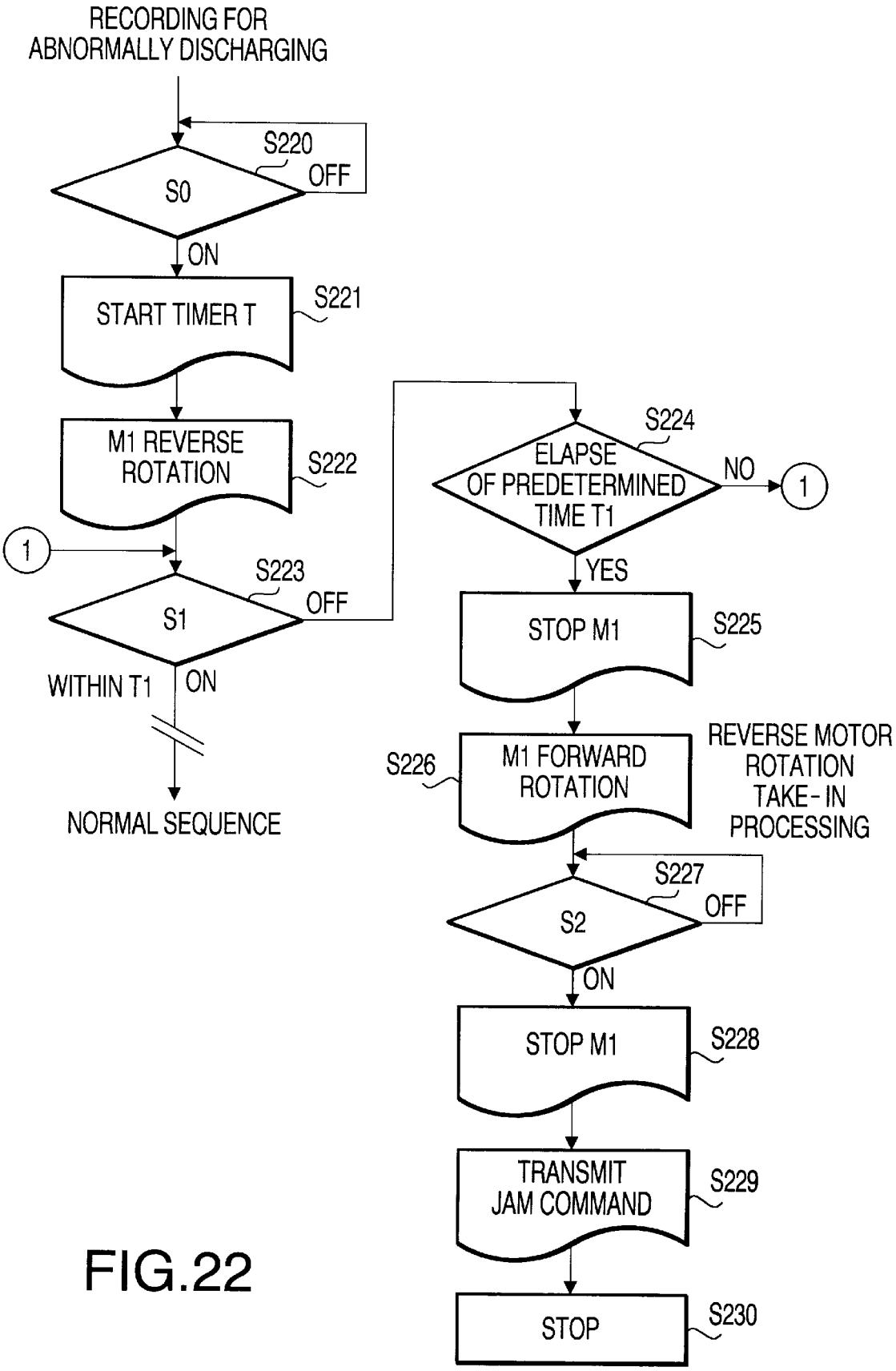
FIG. 22 is a flow diagram for abnormal discharging processing in the above recording apparatus.

FIGS. 21 and 22 are flow diagrams for the control section of the recording apparatus to execute the abnormal processing. The control section recognizes whether the recording side of the recording paper is the first side or second side. FIG. 21 illustrates the processing performed when the automatic both-side recording is selected, the recording on the first side is finished, and the recording on the second side is started.

At the time of starting the second side recording, when main-body discharge sensor S0 detects the passage of the recording paper (S201), first forward-reverse motor M1 is rotated in the forward direction because the recording paper to be recorded on the second side thereof enters the both-side path (S202). By the forward rotation of first forward-reverse motor M1, switching pawl 35 operates to guide the recording paper taken in top unit 4 to second path L2.

However, when switching pawl 35 does not operate sufficiently due to, for example, the aging, the recording paper may enter third path L3 incorrectly. In such a case, discharge sensor S1 detects the recording paper in the judgment at step S203.

When the recording paper is detected at step S203, the forward rotation of first forward-reverse motor M1 is stopped (S204), and then first forward-reverse motor M1 is rotated in the reverse direction (S205). By the reverse rotation of first forward-reverse motor M1, discharge roller 36 rotates in the direction in which the recording paper is discharged. Thereby the recording paper incorrectly entering third path L3 is discharged to the discharge tray by discharge roller 36.

Discharge sensor located before discharge roller 36 in the feeding direction is turned off when the recording paper is completely fed to a side of discharge roller 36. Accordingly after it is confirmed that discharge sensor S1 is turned off from on (S206), the reverse rotation of first forward-reverse motor M1 is stopped (S206).

Then a jam command is transmitted to display an error message (S208), and the automatic both-side recording operation is stopped (S209). In addition, when the recording paper is not detected at S203, the processing flow shifts to step S210 to wait for passing sensor S2 to be turned on by the detection of the recording paper.

In the case where switching pawl 35 does not operate sufficiently due to, for example, the aging, when the control is performed to return the recording paper to switching pawl 35, and set the direction of switching pawl 35 in the right direction to feed the recording paper again, the paper jam tends to occur in a switching area of the path. However in this embodiment, the recording paper is discharged to an incorrect path when switching pawl 35 provides the incorrect path, without correcting the path, it is possible to prevent the occurrence of paper jam, and to notify the user of the abnormality of the apparatus by discharging the recording paper, therefore making it possible to urge the operator to perform an appropriate action.

Further discharge sensor S1 on third path L3 is a sensor to confirm that the recording paper is discharged while monitoring at the time the second sided recording is finished in the case of the automatic both-side recording, and the same sensor detects the occurrence of the malfunction while monitoring at the time the second sided recording is started. Therefore it is possible to judge the presence or absence of the malfunction using the preexisting discharge sensor without increasing the number of components.

FIG. 22 illustrates processing performed when the automatic both-side recording is selected, and the second sided recording is finished. The recording paper with the second sided recording finished is pushed out of discharge roller 25 of main body unit 1, and taken in top unit 4. When main-body discharge sensor S0 detects the passage of the recording paper at the time the second sided recording is finished (S220), the control section starts checking an internal timer (S221). Further first forward-reverse motor M1 is rotated in the reverse direction (S222). When first forward-reverse motor M1 is rotated in the reverse direction, switching pawl 35 operates to guide the recording paper from first path L1 to third path L3, and the discharge roller provided on third path L3 is rotated. Thereby, the recording paper with the second sided recording finished is ready to be discharged.

However in the case where the recording paper enters second path L2 from first path L1 incorrectly due to the fact that switching pawl 35 does not operate sufficiently, discharge sensor S1 is not turned on even if the time passes. In the case where the recording paper is led to third path L3 due to the normal operation of switching pawl 35, it is possible to predict the time during which main-body discharge sensor S0 is turned on, and then discharge sensor S1 is turned on. Herein it is assumed that the time obtained by adding the predict time to a margin is T1.

When it is determined that discharge sensor S1 is "OFF" at step S223, the processing flow shifts to step S224 to check the time of the timer. When the check shows that time T1 elapses, it can be judged that the recording paper enters second path L2 incorrectly, and first forward-reverse motor M1 is stopped (S225).

Next first forward-reverse motor M1 is rotated in the forward rotation (S226). When first forward-reverse motor M1 is rotated in the forward rotation, feed roller 37 on paper path 32 in top unit 4 rotates in the feeding direction of the both-side path. Accordingly the recording paper incorrectly entering second path L2 is =fed in the forward direction on paper path 32.

When passing sensor S2, located at the rear end in the feeding direction on paper path 32 in top unit 4, is turned on, first forward-reverse motor M1 is stopped again (S227). By stopping first forward-reverse motor M1 when the top end of the recording paper comes to a position of passing sensor S2, the recording paper stops at a position corresponding to cover 33 of top unit 4 and stays there.

Next the jam command is transmitted to display the error command (S229), and the automatic doubled sided recording is stopped (S230).

Thus when switching pawl 35 guides the recording paper to second path L2 at the time the second sided recording is finished in the automatic both-side recording, it is possible to stop the recording paper at the position corresponding to cover 33 that is the paper jam removing mechanism, and to cope with the incorrect situation without performing the control to return the recording paper to switching pawl 35, and set the direction of switching pawl 35 at the right direction to feed the recording paper again. Accordingly it is possible to prevent the occurrence of the paper jam, further to make the situation where the recording paper is present at the corresponding position when the removing mechanism of the both-side path is opened in the case where the recording paper is not discharged, and therefore to facilitate the operation for removing the recording paper entering an incorrect path.

Further by limiting the time for discharge sensor S1 of third path L3 to monitor, it is judged that the recording paper is present on second path L2 when the recording paper is not detected after monitoring for a predetermined time, whereby it is possible to judge the malfunction without increasing the number of components.

The following explains the successive feeding operation in the recording apparatus of this embodiment with reference to FIGS. 23 to 29. The driving system of the both-side path of the recording apparatus is controlled by first forward-reverse motor M1 and second forward-reverse motor M2.

First forward-reverse motor M1 provided in top unit 4 controls the driving systems of top unit 4 and rear unit 3. In other words, first forward-reverse motor M1 controls the operations of switching pawl 35, discharge roller 36, and feed roller 37 of top unit 4, and feed rollers 39 and 40 of rear unit 3. When first forward-reverse motor M1 rotates in the forward direction, switching pawl 35 operates to guide the recording paper to the side of the both-side path, and feed rollers 37, 39 and 40 rotate to feed the recording paper in the forward direction. On the other hand, when first forward-reverse motor M1 rotates in the reverse direction, switching pawl 35 operates to guide the recording paper to the discharge tray side, and feed rollers 37, 39 and 40 does not rotate due to idle operations of respective internal one-way clutches.

Second forward-reverse motor M2 provided in inversion unit 2 controls the driving system of inversion unit 2. In other words, second forward-reverse motor M2 controls the operations of forward-reverse roller 46, and feed rollers 51*a* to 54*a* and 64. When second forward-reverse motor M2 rotates in the forward direction, forward-reverse roller 46 rotates in the direction in which the recording paper is drawn into draw-in path 45, and feed rollers 51*a* to 54*a* and 64 does not rotate due to idle operations of respective internal one-way clutches. On the other hand, when second forward-reverse motor M2 rotates in the reverse direction, forward-reverse roller 46 rotates in the direction in which the recording paper is pushed out of draw-in path 45, and feed rollers 51*a* to 54*a* and 64 rotate to feed the recording paper in the forward direction.

The recording apparatus configured as described above operates as described below when the automatic both-side recording is selected in a panel section thereof that is not shown in the figure. A first sheet of recording paper D1 taken out from the paper cassette is fed to the one-side path. The recording is first performed on a reverse side (②) of the recording paper D1 in the recording section (resist roller 15, transfer unit 16, transfer roller 18 and fixing unit 21) in the one-side path. The recording paper D1 with the reverse side (②) recorded is fed to top unit 4 by discharge roller 25.

In top unit 4, in response to "ON" of main-body discharge sensor S0, first forward-reverse motor M1 is rotated in the forward direction, and thereby the recording paper D1 is led to the both-side path side by switching pawl 35. The recording paper D1 entering the both-side path is fed to inversion unit 2 through top unit 4 and rear unit 3 by feed rollers 37, 39 and 40 driven by first forward-reverse motor M1.

Figure 23:
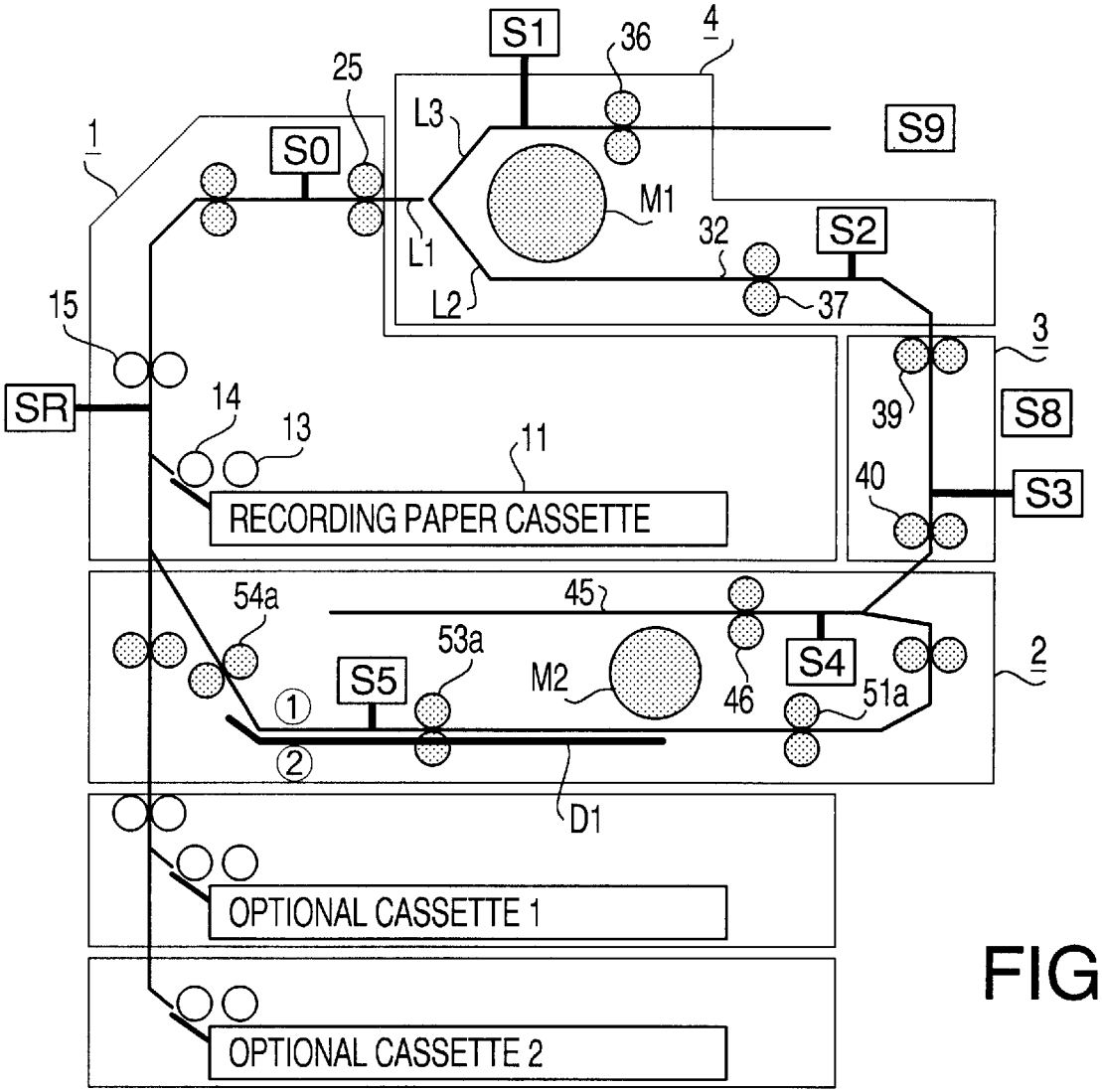
FIG. 23 is a perspective diagram of the above recording apparatus with a sheet of recording paper (D1) waiting.

In inversion unit 2, inversion sensor S4 is first turned on, and thereby second forward-reverse motor M2 is rotated in the forward direction. Therefore the recording paper D1 is drawn into draw-in path 45 by forward-reverse roller 46. When the rear end of the recording paper D1 drawn into draw-in path is passed through inversion sensor S4, inversion sensor S4 is turned off. When inversion sensor S4 is turned off, second forward-reverse motor M2 is rotated in the reverse direction, and thereby the recording paper D1 is drawn out from the rear end thereof. Since the reverse rotation of second forward-reverse motor M2 drives feed rollers 64 and 51*a* to 53*a*, the recording paper D1 is inverted by 180 degrees by the pair of guides 62 and 63, and enters inversion path 47. Outlet sensor S5 detects the recording paper D1 entering inversion path 47. When outlet sensor S5 is turned on, the drive of second forward-reverse motor M2 is stopped, and the recording paper D1 is set to wait immediately before entering the one-side path. FIG. 23 illustrates the situation in which recording paper D1 waits immediately before entering the one-side path in inversion unit 2. In this situation, a right side (①) of the recording paper D1 is a surface to be subjected to next recording.

Figure 24:
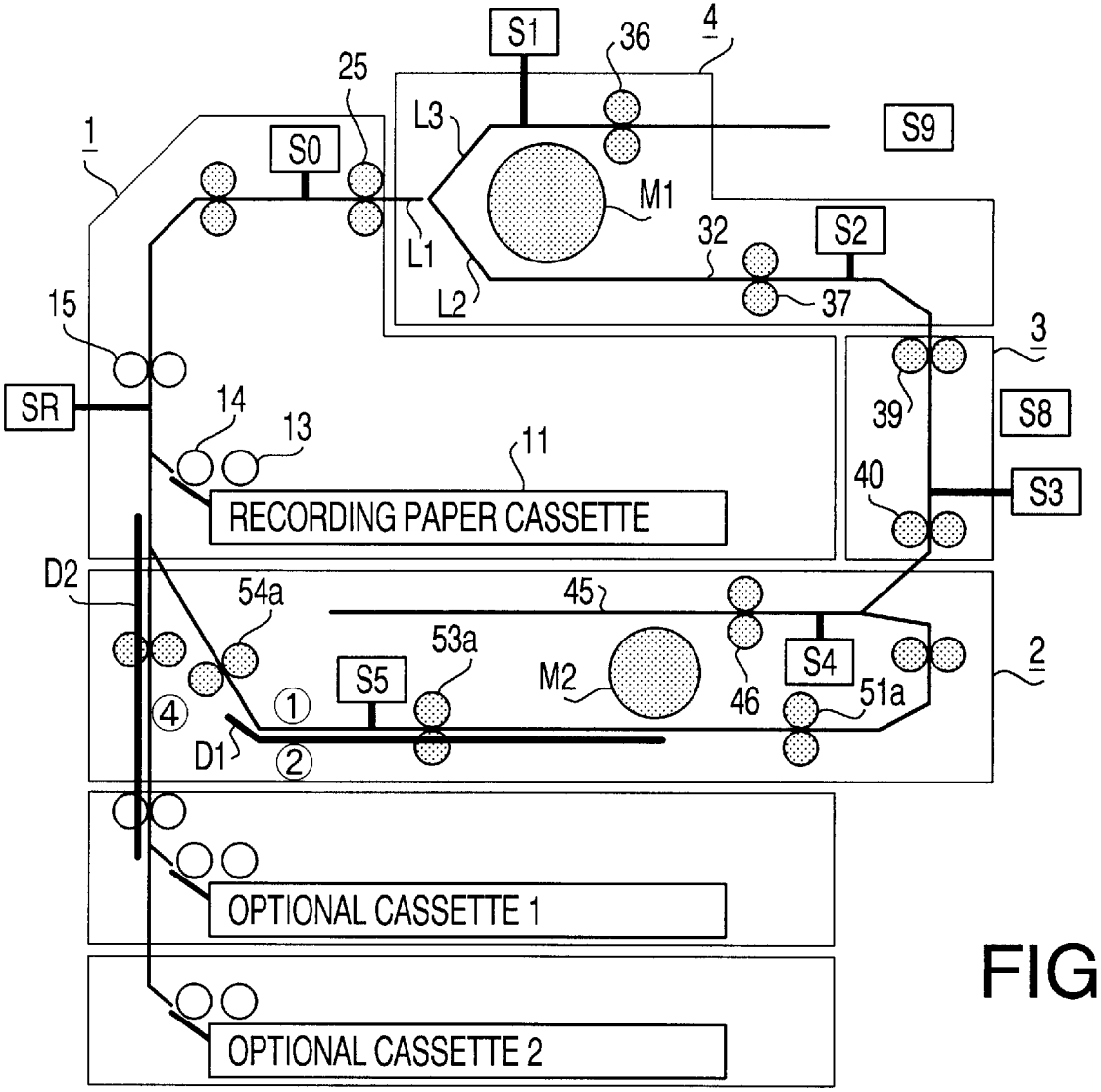
FIG. 24 is a perspective diagram of the above recording apparatus with the sheet D1 waiting and with another sheet of recording paper (D2) taken in a one-side path.
Figure 25:
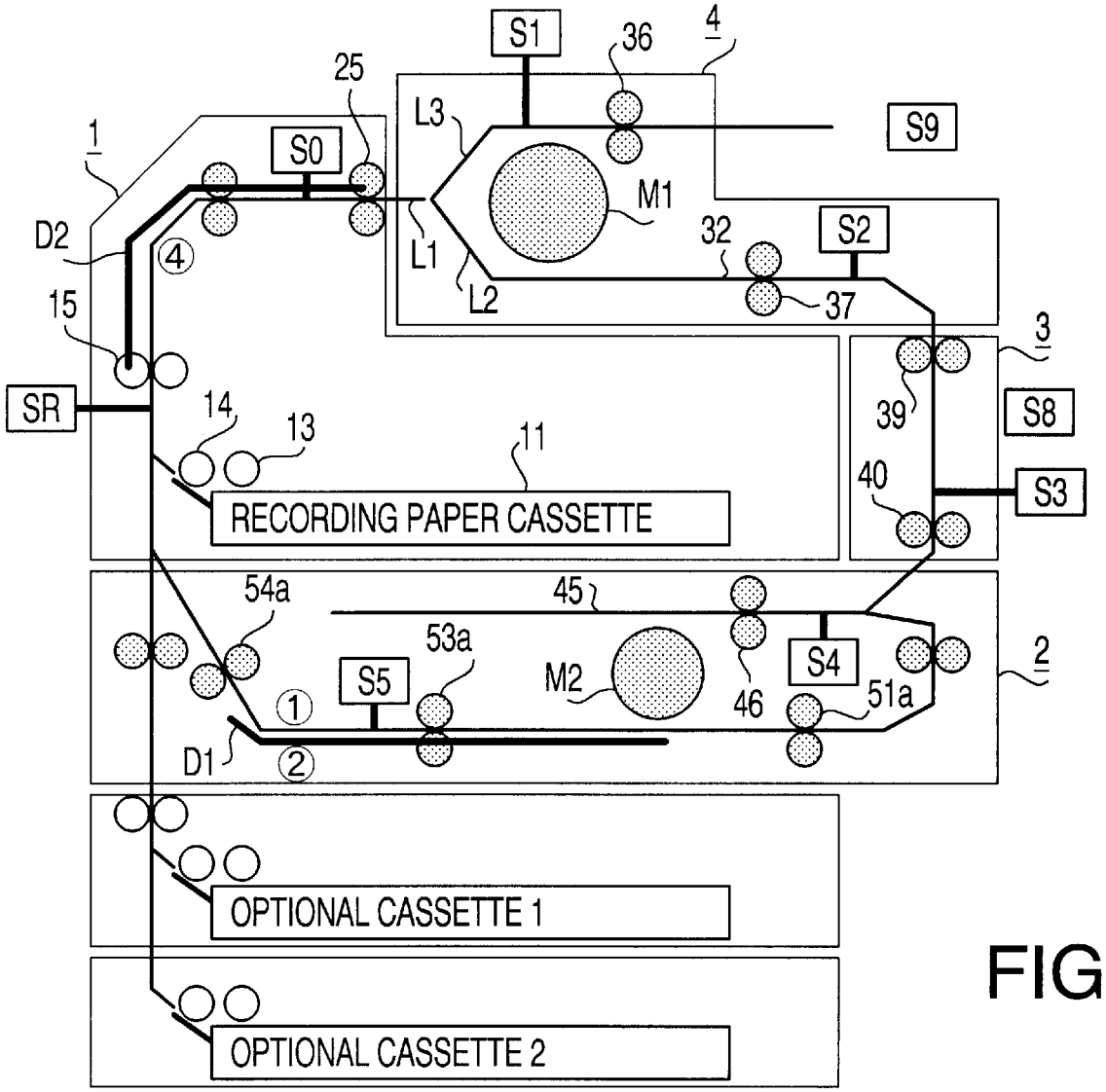
FIG. 25 is a perspective diagram of the above recording apparatus with the sheet D1 waiting and with the sheet D2 subjected to recording.

Next, as illustrated in FIG. 24, with the first sheet of recording paper D1 waiting, the second sheet of recording paper D2 is taken out from the paper cassette, and fed to the one-side path. FIG. 24 illustrates the case that the recording paper is taken out from an optional paper cassette further installed. In addition, the recording paper may be taken out from paper cassette 11 of main body unit 1. While the recording paper D2 is passed through the recording section of the one-side path, the recording is first performed on a reverse side (④) thereof. FIG. 25 illustrates the situation where the first sheet of recording paper D1 is set to wait in inversion unit 2 for the second sheet of recording paper D2 to be passed through the recording section.

Figure 26:
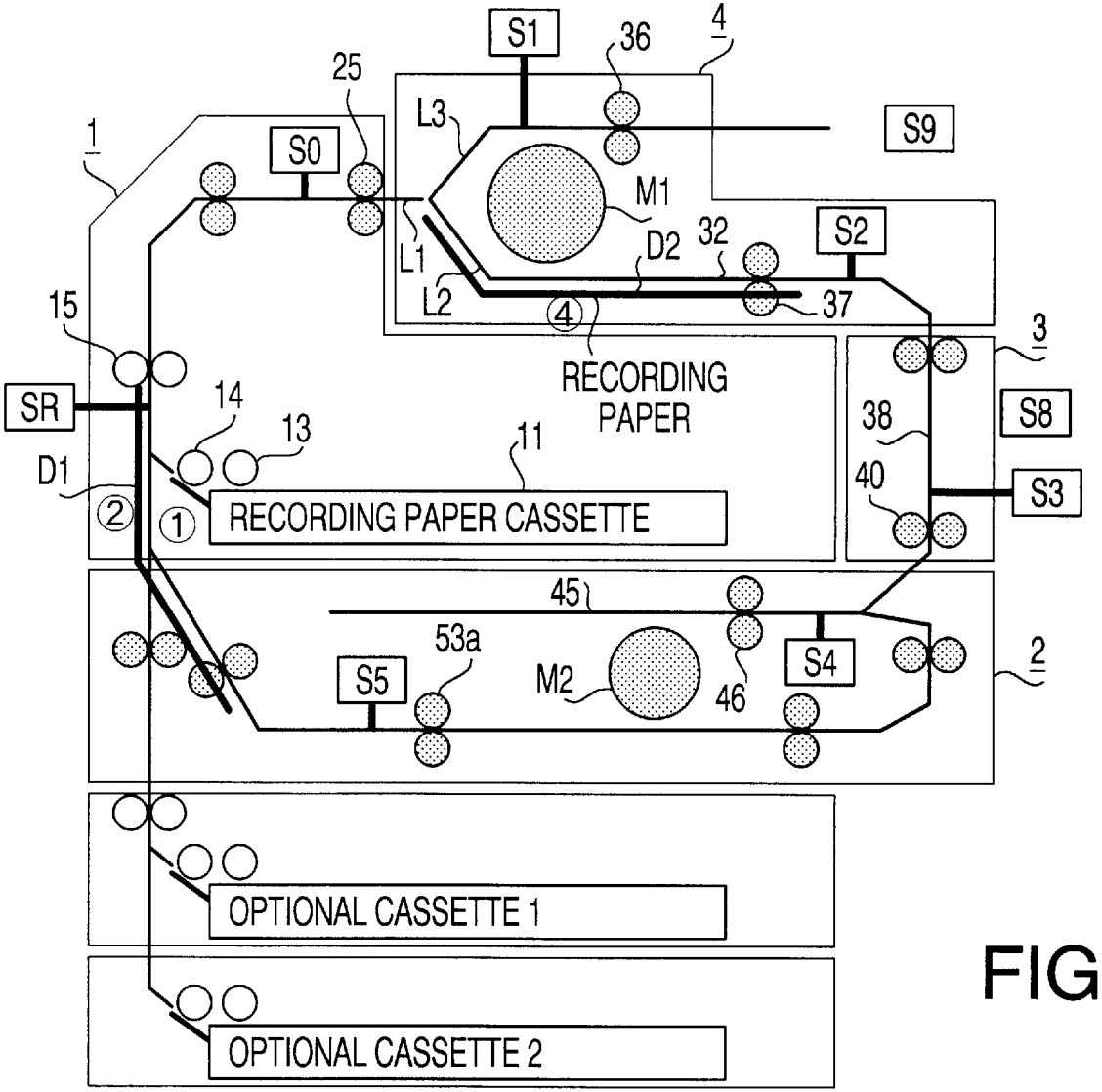
FIG. 26 is a perspective diagram of the above recording apparatus with the waiting sheet D1 fed to the one-side path and with the sheet D2 taken to a both-side path.

Next after the second sheet of recording paper D2 passed through the recording section is detected by main-body discharge sensor S0, first forward-reverse motor M1 is rotated in the forward direction, and second forward-reverse motor M2 is rotated in the reverse direction. Thereby, as illustrated in FIG. 26, the second sheet of recording paper D2 is taken in the both-side path in top unit 4, and the first sheet of recording paper D1 waiting in inversion unit 2 is fed to the one-side path.

Figure 27:
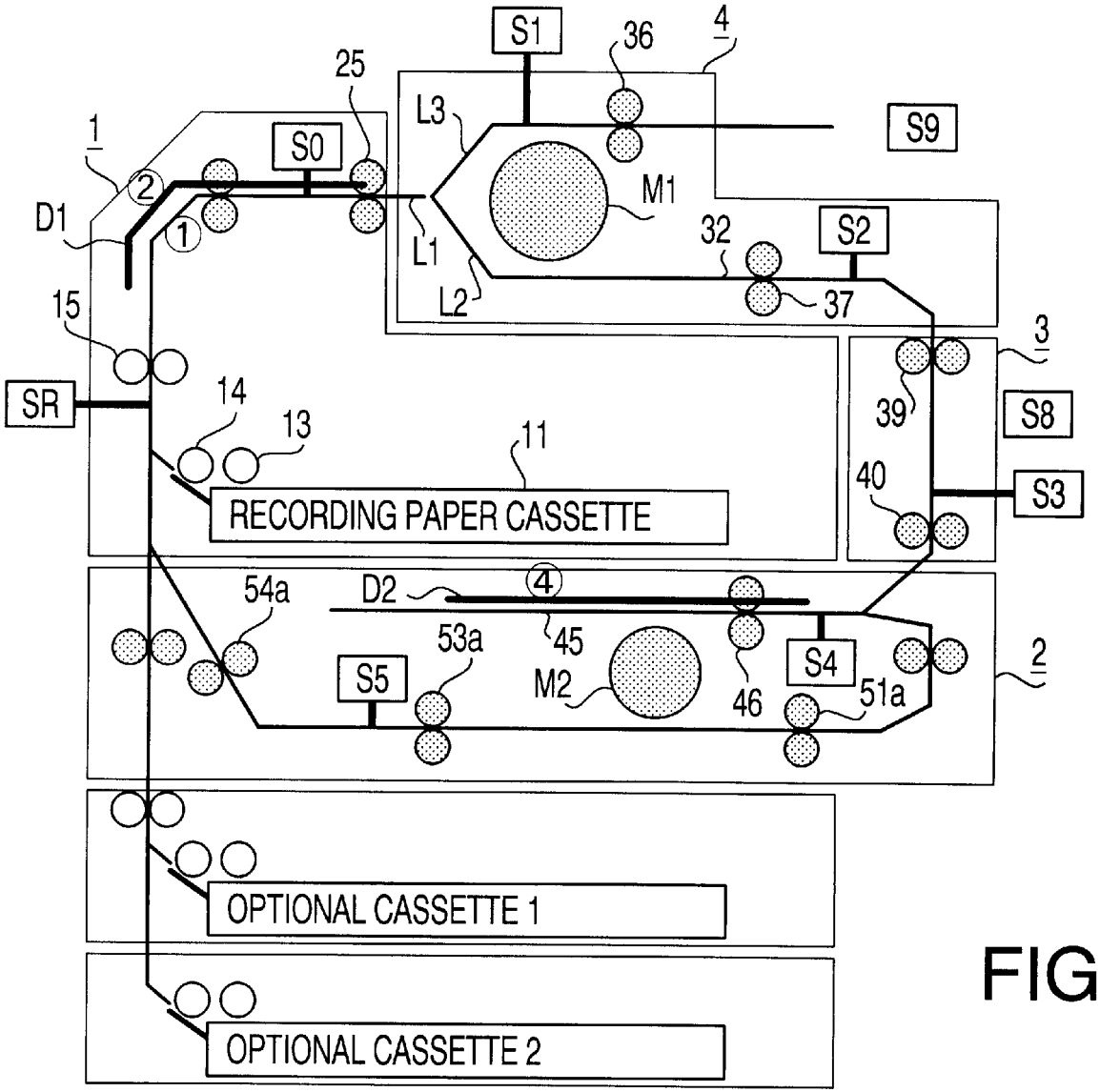
FIG. 27 is a perspective diagram of the above recording apparatus with the sheet D1 subjected to recording and with the sheet D2 fed to the inversion section.

While the recording is performed on the first sheet of recording paper D1 in the recording section, the second sheet of recording paper D2 is fed to inversion unit 2 through top unit 4 and rear unit 3. FIG. 27 illustrates the situation where the recording is performed on the first sheet of recording paper D1 in the recording section of the one-side path, and the second sheet of recording paper D2 is drawn into draw-in path 45 in inversion unit 2.

When the first sheet of recording paper D1 is detected by main-body discharge sensor S0, the control section of the recording apparatus determines the side of the recording paper D1 on which the recording is finished. As a result of the determination, when it is determined that the recording on the second side (right surface ①) is finished, first forward-reverse motor M1 is rotated in the reverse direction. Thereby the first sheet of recording paper D1 taken in top unit 4 is led to the discharge tray side by switching pawl 35 to be discharged. When discharge sensor S1 detects the rear end of the recording paper D1 ("OFF"), first forward-reverse motor M1 is stopped.

Figure 28:
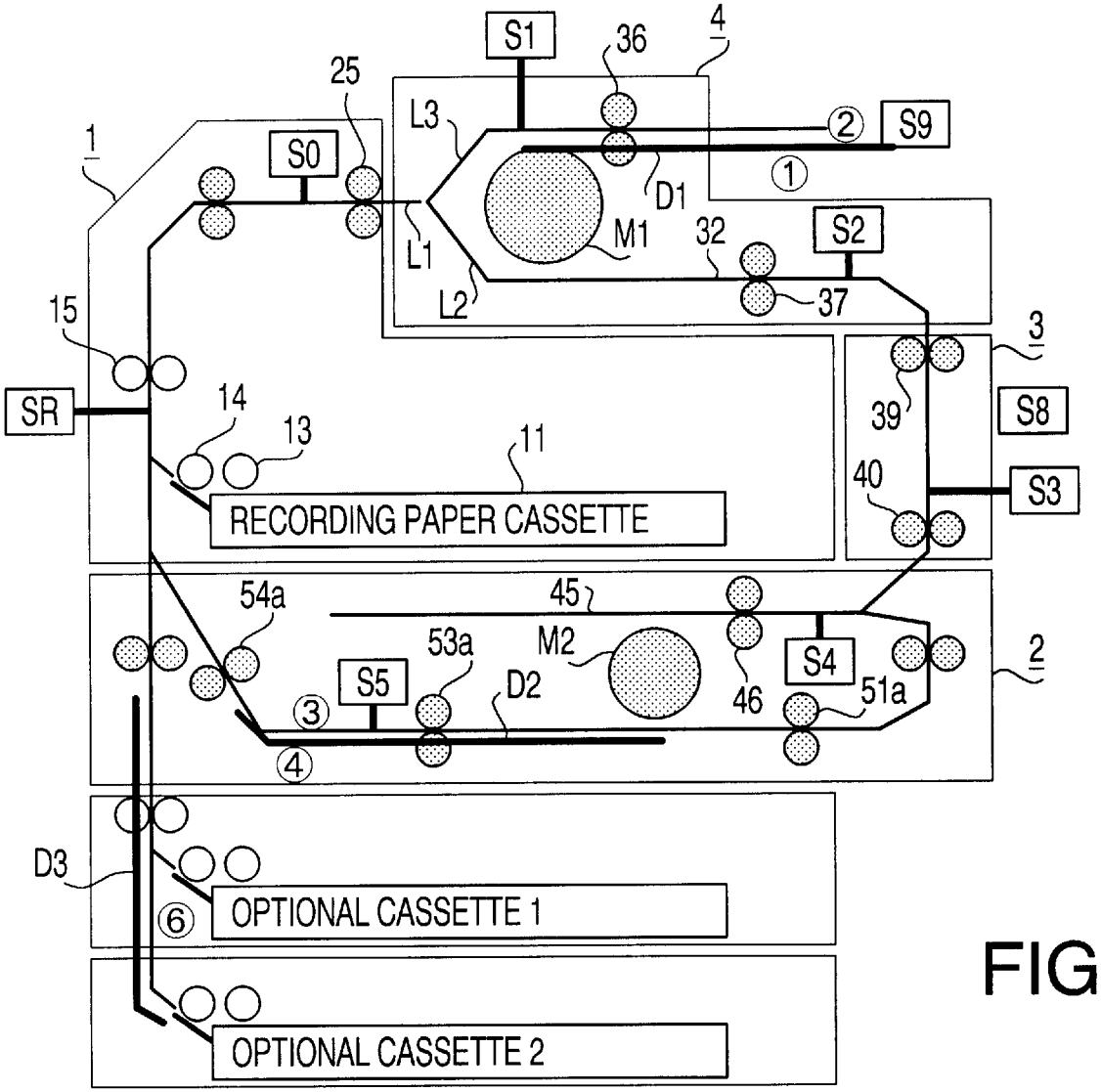
FIG. 28 is a perspective diagram of the above recording apparatus with the sheet D1 discharged and with the sheet D2 waiting.
Figure 29:
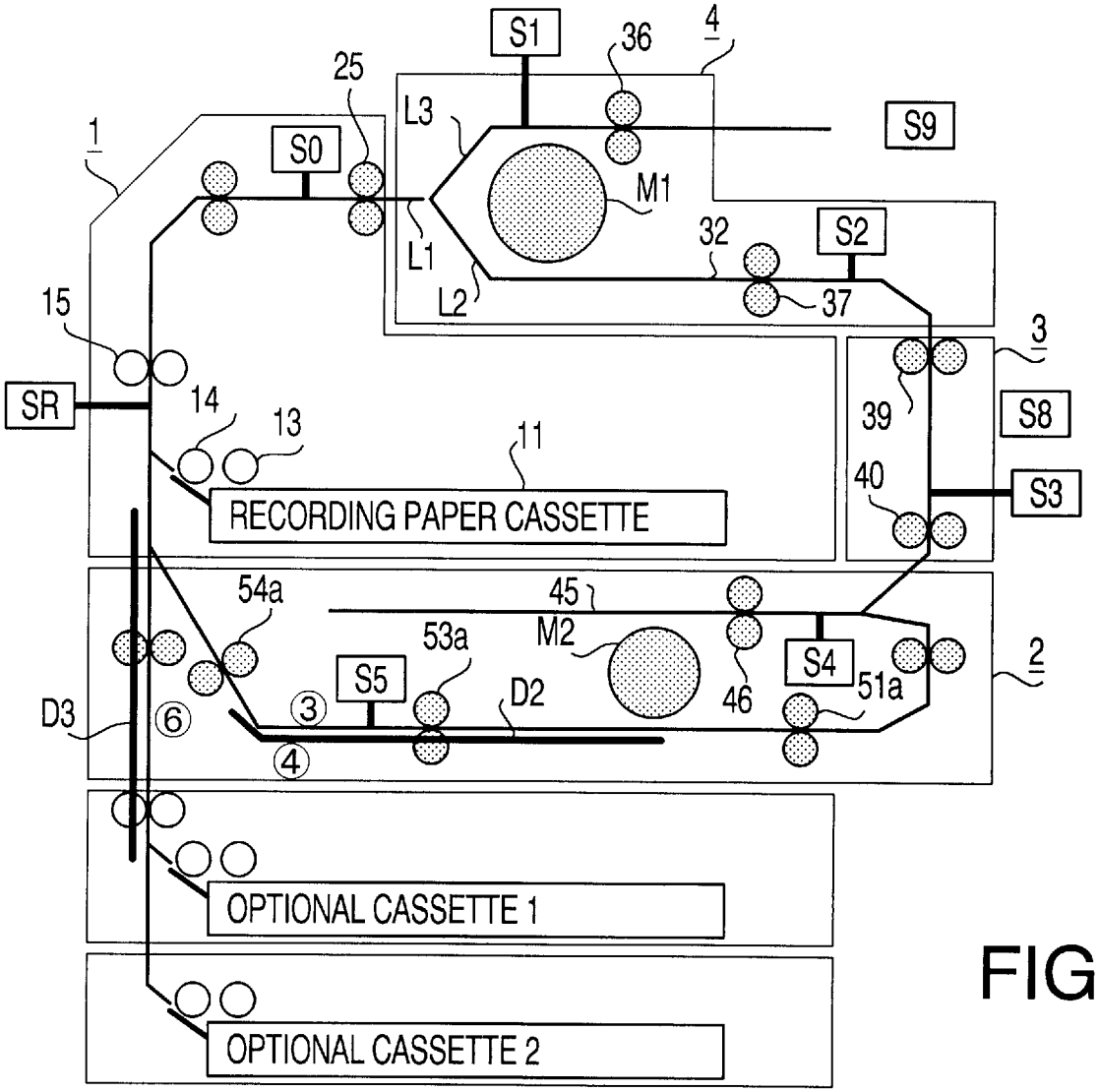
FIG. 29 is a perspective diagram of the above recording apparatus with the sheet D2 waiting and with the other sheet of the recording paper fed to the one-side path.

Meanwhile the second sheet of recording paper D2 entering inversion unit 2 is inverted, and then set to wait directly before the both-side path. Then the third sheet of recording paper D3 is taken out from the paper cassette, and to fed to the one-side path. FIG. 28 illustrates the above situation. Then as illustrated in FIG. 29, the third sheet of recording paper D3 is fed to the recording section of the one-side path, while the second sheet of recording paper D2 waits in inversion unit 2.

Thus first forward-reverse motor M1 controls the paper path switching and recording paper feeding on the both-side path in top unit 4 and rear unit 3, and second forward-reverse motor M2 controls the inversion and waiting on the path in inversion unit 2, whereby it is possible to control positions of the sheets of recording paper with the simplified control performed only by switching first and second forward-reverse motors M1 and M2.

Further under the control of forward and reverse rotations of first and second forward-reverse motors M1 and M2, while one sheet of recording paper is set to wait immediately before entering the one-side path, another sheet of recording paper is taken out from the paper cassette, and fed to the recording section on the one-side path. Therefore it is possible to properly control the recording timing while properly holding an interval between the sheets of recording paper. Furthermore it is possible to correct the position as appropriate even if the recording paper is ahead or behind than expected on the way, and thereby it is possible to continue the proper circulation of the recording paper.

Moreover the recording of this embodiment makes a feed speed in an interval between transfer unit 16 and fixing unit 21 lower than another feed speed in areas other than the above interval. Specifically the lower feed speed is applied during the interval when the top end of the recording paper is fed to transfer unit 16 and then the rear end of the recording paper is fed out of fixing unit 21.

Figure 30:
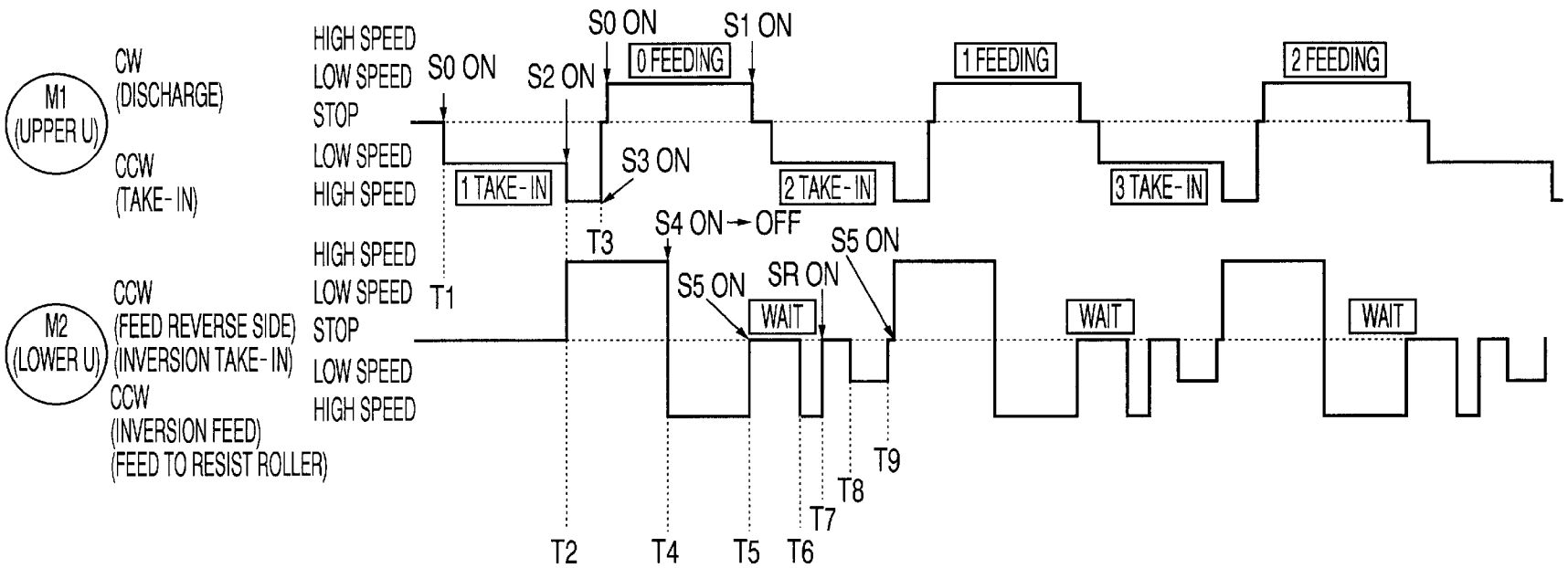
FIG. 30 is a timing diagram illustrating switching timing between a high speed, low speed and stopping in a first forward-reverse M1 and second forward-reverse motor M2.

FIG. 30 illustrates switching timings between high speed, low speed and stop by first and second forward-reverse motors M1 and M2. At time T1 when main-body discharge sensor S0 detects the recording paper passed through the recording section on the one-side path, first forward-reverse motor M1 starts the forward rotation at a low speed to take in the recording paper. Taking in the paper at the low speed is to set the feed speed of the recording paper in the recording section at a speed appropriate for the processes of charging, development, transfer and fixing in the recording section. The image quality deteriorates when the recording paper is taken in at a high speed during the interval when the rear end of the recording paper is being passed through these processes.

Next at time T2 when passing sensor S2 in top unit 4 is turned on, the rotation speed of first forward-reverse motor M1 is set at the high speed, and second forward-reverse motor M2 is also rotated at the high speed. At time T2 when passing sensor S2 is turned on, since the recording paper is completely taken in top unit 4, the recording paper is fed to the innermost portion in draw-in path 45 in inversion unit 2 at the high speed.

In addition, at time T3 when passing sensor S3 is turned on, since the recording paper completely moves to rear unit 3 from top unit 4, first forward-reverse motor M1 is stopped in top unit 4. Then when main-body discharge sensor S0 is turned on, first forward-reverse motor M1 is rotated in the reverse direction to discharge the recording paper with images recorded on both sides thereof to the charge tray side. At this point, since the rear end of the recording paper is being passed through the recording process, the speed of first forward-reverse motor M1 is set at the low speed. When discharge sensor S1 is turned on due to the fact that the recording paper is completely discharged, first forward-reverse motor M1 is stopped.

Meanwhile in inversion unit 2, the recording paper is fed to draw-in path 45 at the high speed. At time T4 when the passage of the rear end of recording paper turns inversion sensor 4 on, the rotation direction of second forward-reverse motor M2 is reversed, and the motor M2 is rotated in the reverse direction at the high speed. Thereby the recording paper is fed from draw-in path 45 to inversion path 47 at the high speed.

At time T5 when discharge sensor S5 detects the top end of the recording paper, second forward-reverse motor M2 is stopped. During a waiting period of from time T5 to time T6, another sheet of recording paper is taken out from the paper cassette, and fed to the recording section on the one-side path. At time T6, the recording section has no recording paper. Then second forward-reverse motor M2 is rotated in the reverse direction at the high speed to feed the recording paper from inversion path 47 to resist roller 15 on the one-side path at the high speed. At time T7 when resist sensor SR is turned on, since the top end of the recording paper arrives at resist roller 15, the rotation of second forward-reverse motor M2 is once stopped to adjust a recording starting timing. At time T8 when the recording section gets ready, second forward-reverse motor M2 is rotated again in the reverse direction at the low speed at this time to feed the recording paper. At time T9 when discharge sensor S5 detects that the rear end of the recording paper is passed through, second forward-reverse motor M2 is stopped.

Thus circulating the both-side path along the outer edge of main body unit 1 results in the longer total length of the both-side path, however the feed speed is switched to be higher in areas other than the process interval in which the feed speed is specified by the applied process. Therefore it is possible to maintain the appropriate speed in the process interval, and also to speed up the entire paper feeding.

As specifically described above, according to the present invention, it is possible to provide a recording apparatus with an improved paper jam removing operability while being provided with a both-side path for both-side recording.

The present invention is not limited to the above described embodiments, and various variations and modifications may be possible without departing from the scope of the present invention.

This application is based on the Japanese Patent Application No. HEI11-202966 filed on Jul. 16, 1999, entire content of which is expressly incorporated by reference herein.

What is claimed is:

1. A recording apparatus comprising:

a housing comprising a main body of the apparatus;

a recording section provided inside the housing;

a one-side path, formed inside the housing, which is configured to feed recording paper to the recording section, and to discharge the recording paper out of said housing with an image recorded thereon; and a two-side path that is formed around an outer edge of the housing except an area of the one-side path, and that returns the recording paper discharged from the two-side path to the one-side path after inverting the recording paper, wherein the two-side path extends along outer edges of a top, a rear and a bottom of the housing to return to the one-side path.

2. The recording apparatus according to claim 1, wherein the two-side path has a path section that inverts the recording paper in a bottom area of the housing to return to the one-side path.

3. The recording apparatus according to claim 1, wherein the two-side path includes a plurality of mechanisms for removing a paper jam, each of the removing mechanisms being provided independently at respective areas corresponding to the top, the rear and the bottom of the housing.

4. The recording apparatus according to claim 1, wherein said two-side path comprises a plurality of units each serially connected on the top, the rear and at the bottom of said housing, each unit including a mechanism for independently removing a paper jam from said housing, and the top unit being attached to said housing so as to enable the top unit to be opened and shut.

5. The recording apparatus according to claim 4, wherein the top unit removing mechanism and the rear unit removing mechanism each comprise a cover, and the removing mechanism of the unit located at the bottom comprises a drawer.

6. The recording apparatus according to claim 4, wherein the removing mechanism of the unit located at the bottom comprises a drawer, the drawer storing an inversion mechanism that inverts the recording paper, the inversion mechanism being movable with the drawer.

7. The recording apparatus according to claim 6, wherein the inversion mechanism comprising a pair of rollers that feed the recording paper, with the recording paper being held therebetween.

8. The recording apparatus according to claim 6, wherein the inversion mechanism comprises a guide that guides the recording paper and acts on one side of the recording paper and another guide that guides the recording paper and acts on an other side of the recording paper in a predetermined region.

9. The recording apparatus according claim 6, wherein the inversion mechanism comprises a guide that guides the recording paper and acts on one side of the recording paper and a roller that feeds the recording paper and acts on an other side of the recording paper in a predetermined region.

10. The recording apparatus according to claim 6, wherein the inversion mechanism is provided at an innermost position of the drawer in a direction in which the drawer is moved.

11. A recording apparatus comprising:

a housing comprising a main body of the apparatus;

a recording section provided inside the housing;

a one-side path, formed inside the housing, which is configured to feed recording paper to the recording section, and to discharge the recording paper out of said housing with an image recorded thereon;

a two-side path that is formed around an outer edge of the housing except an area of the one-side path, and that returns the recording paper discharged from the two-side path to the one-side path after inverting the recording paper;

a switching mechanism configured to change a feeding direction of the recording paper coming from a first path, and provided at a branch point between a second path and a third path;

a control section configured to guide the recording paper to a discharge outlet of the two-side path through the third path when the switching mechanism changes the feeding direction to the third path when recording on a second side of the recording paper; and a discharge sensor that detects the recording paper fed to the third path, wherein the first path connects a discharge outlet of the one-side path and an inlet of the two-side path, the second path connects the first path and the two-side path, and the third path connects the first path and the discharge outlet of the two-side path, wherein, when the discharge sensor detects recording on the second side of the recording paper, the control section determines that the switching mechanism has incorrectly guided the recording paper to the third path, when recording on the second side in the two-side recording.

12. A recording apparatus comprising:

a housing comprising a main body of the apparatus;

a recording section provided inside the housing;

a one-side path, formed inside the housing, which is configured to feed recording paper to the recording section, and to discharge the recording paper out of said housing with an image recorded thereon;

a two-side path that is formed around an outer edge of the housing except an area of the one-side path, and that returns the recording paper discharged from the two-side path to the one-side path after inverting the recording paper, a switching mechanism configured to change a feeding direction of the recording paper coming from a first path, and provided at a branch point between a second path and a third path;

a control section configured to stop the recording paper at a predetermined position corresponding to a mechanism for removing a paper jam of the two-side path when the switching mechanism changes the feeding direction of the recording paper to the second path when recording on a second side of the recording paper is finished in two-side recording, and a discharge sensor that detects the recording paper discharged to the third path, wherein the first path connects a discharge outlet of the one-side path and an inlet of the two-side path, the second path connects the first path and the two-side path, and the third path connects the first path and a discharge outlet of the both-side path, wherein, when the discharge sensor does not detect the recording paper after elapse of a predetermined time when recording on the second side is finished, the control section determines that the switching mechanism has incorrectly guided the recording paper to the second path.

13. A recording apparatus comprising:

a housing comprising a main body of the apparatus;

a recording section provided inside the housing;

a one-side path, formed inside the housing, which is configured to feed recording paper to the recording section, and to discharge the recording paper out of said housing with an image recorded thereon;

a two-side path that is formed around an outer edge of the housing except an area of the one-side path, and that returns the recording paper discharged from the two-side path to the one-side path after inverting the recording paper, and a holding mechanism that holds a pinch roller opposite to a driving roller by separately pressing both sides of a shaft of the pinch roller against the driving roller, the recording paper first coming into contact with the driving roller in the two-side path.

14. A recording apparatus comprising:

a housing comprising a main body of the apparatus;

a recording section provided inside the housing;

a one-side path, formed inside the housing, which is configured to feed recording paper to the recording section, and to discharge the recording paper out of said housing with an image recorded thereon;

a two-side path that is formed around an outer edge of the housing except an area of the one-side path, and that returns the recording paper discharged from the two-side path to the one-side path after inverting the recording paper;

an inclination mechanism configured to forcibly incline the recording paper at a final area of the two-side path so that a corner of the recording paper first comes into contact with a reference surface, while feeding the recording paper, and a correction mechanism that corrects an orientation of the forcibly inclined recording paper to be aligned with respect to the reference surface, and returns the recording paper to the one-side path.

15. The recording apparatus according to claim 14, wherein the inclination mechanism comprises a system that forcibly inclines the recording paper with respect to the reference surface at an area before a final area of said both-side path; and an inversion system that inverts the recording paper by feeding the forcibly inclined recording paper in a reverse direction.

16. A recording apparatus comprising:

a housing comprising a main body of the apparatus;

a recording section provided inside the housing;

a one-side path, formed inside the housing, which is configured to feed recording paper to the recording section, and to discharge the recording paper out of said housing with an image recorded thereon; and a two-side path that is formed around an outer edge of the housing except an area of the one-side path, and that returns the recording paper discharged from the two-side path to the one-side path after inverting the recording paper, wherein a feed speed in a region within which a top end of recording paper is fed to a transfer section and then a rear end of recording paper is fed out of a fixing section is set to be lower than a feed speed in an area other than in the region.

17. A recording apparatus comprising:

a housing comprising a main body of the apparatus;

a recording section provided inside the housing;

a one-side path, formed inside the housing, which is configured to feed recording paper to the recording section, and to discharge the recording paper out of said housing with an image recorded thereon;

a two-side path that is formed around an outer edge of the housing except an area of the one-side path, and that returns the recording paper discharged from the two-side path to the one-side path after inverting the recording paper, wherein the two-side path extends within a plurality of units located on a top, on a rear and at a bottom of the housing, each of said plurality of units comprising a separable unit.

18. The recording apparatus according to claim 17, wherein in the plurality of units, positioning members for each unit comprising fixing members connect and fix each unit.

19. A recording apparatus comprising:

a housing comprising a main body of the apparatus;

a recording section provided inside the housing;

a one-side path, formed inside the housing, which is configured to feed recording paper to the recording section, and to discharge the recording paper out of said housing with an image recorded thereon;

a two-side path that is formed around an outer edge of the housing except an area of the one-side path, and that returns the recording paper discharged from the two-side path to the one-side path after inverting the recording paper;

a plurality of sensors arranged on the two-side path at spaced intervals that are longer than a length of the recording paper; and a control section configured to judge whether or not any of the plurality of sensors detects the recording paper while driving rollers on the two-side path during an initial operation time.

20. A recording apparatus comprising:

a housing comprising a main body of the apparatus;

a recording section provided inside the housing;

a one-side path, formed inside the housing, which is configured to feed recording paper to the recording section, and to discharge the recording paper out of said housing with an image recorded thereon;

a two-side path that is formed around an outer edge of the housing except an area of the one-side path, and that returns the recording paper discharged from the two-side path to the one-side path after inverting the recording paper;

a switching mechanism that switches a feeding direction of the recording paper discharged from the one-side path to one of the two-side path and a discharge outlet of the two-side path;

an inversion section, provided on the two-side path, which is configured to draw in the recording paper from a top end thereof, and to push the recording paper out from a rear end thereof, to invert the recording paper;

a first reversible motor that drives the switching mechanism; and a second reversible motor that drives said inversion section to switch between draw-in and push-out operations, wherein said first reversible motor controls a driving system in which the recording paper is fed from the switching mechanism to an intermediate position before the inversion section, and the second reversible motor controls another driving system in which the recording paper is fed from the intermediate position to said one-side path.

21. The recording apparatus according to claim 20, wherein a first sheet of the recording paper is drawn out of the inversion section by a reverse rotation of the second reversible motor, and the first sheet waits before returning to the one-side path, while a second sheet of recording paper is fed from a paper cassette to the one-side path while the first sheet of the recording paper waits.

22. The recording apparatus according to claim 21, wherein, while the second sheet is taken into the two-side path by a forward rotation of the first reversible motor, the first sheet, waiting before returning to said one-side path is provided to the one-side path by reverse rotation of the second reversible motor, thereafter the second sheet in said two-side path is drawn into the inversion section by a forward rotation of said second reversible motor, and the first sheet, fed from the two-side path to the one-side path is discharged from the discharge outlet of the two-side path by a reverse rotation of the first reversible motor.

23. The recording apparatus according to claim 22, wherein the second sheet is drawn out of the inversion section by the reverse rotation of the second reversible motor, and waits before returning to the one-side path in the housing.

* * * * *